US011262079B2

(12) United States Patent
Gauss et al.

(10) Patent No.: US 11,262,079 B2
(45) Date of Patent: Mar. 1, 2022

(54) COLLAPSIBLE CAMP STOVE

(71) Applicant: GSI Outdoors, Inc., Spokane, WA (US)

(72) Inventors: Kurt F. Gauss, Spokane, WA (US); Trevor O. Tollefspol, Couer D'Alene, ID (US)

(73) Assignee: GSI Outdoors, Inc, Spokane, WA (US)

( * ) Notice: Subject to any disclaimer, the term of this patent is extended or adjusted under 35 U.S.C. 154(b) by 130 days.

(21) Appl. No.: 16/875,674

(22) Filed: May 15, 2020

(65) Prior Publication Data

US 2020/0363068 A1 Nov. 19, 2020

Related U.S. Application Data

(60) Provisional application No. 62/848,363, filed on May 15, 2019.

(51) Int. Cl.

| | |
|---|---|
| ***F24C 3/14*** | (2006.01) |
| ***F24C 15/10*** | (2006.01) |
| ***F24C 15/08*** | (2006.01) |
| ***F24C 3/12*** | (2006.01) |
| ***F24C 15/00*** | (2006.01) |
| ***F24C 15/02*** | (2006.01) |
| ***F24C 3/08*** | (2006.01) |
| ***F24C 3/10*** | (2006.01) |
| ***F23D 14/04*** | (2006.01) |

(52) U.S. Cl.

CPC ..... *F24C 3/14* (2013.01); *F23D 14/04* (2013.01); *F24C 3/085* (2013.01); *F24C 3/103* (2013.01); *F24C 3/12* (2013.01); *F24C 3/126* (2013.01); *F24C 15/007* (2013.01); *F24C 15/022* (2013.01); *F24C 15/08* (2013.01); *F24C 15/086* (2013.01); *F24C 15/107* (2013.01); *F23D 2205/00* (2013.01); *F23D 2207/00* (2013.01)

(58) Field of Classification Search

CPC ..... F23D 14/04; F24C 15/007; F24C 15/022; F24C 15/08; F24C 15/086; F24C 15/107; F24C 15/085; F24C 15/103; F24C 15/14

USPC ..... 126/25 R, 30, 38, 9 R

See application file for complete search history.

(56) References Cited

U.S. PATENT DOCUMENTS

| | | | | | |
|---|---|---|---|---|---|
| 507,828 | A * | 10/1893 | Montanus | F24C 3/14 | 126/38 |
| 999,622 | A * | 8/1911 | Allen | F24C 3/14 | 126/40 |
| 1,496,344 | A * | 6/1924 | Levinson | F24C 3/14 | 126/38 |
| 2,852,016 | A * | 9/1958 | Weatherwax | F24C 3/14 | 126/9 R |
| 2,861,562 | A * | 11/1958 | Ross | F24C 3/14 | 126/38 |
| 2,955,588 | A * | 10/1960 | Axelsson | F24C 3/14 | 126/38 |

(Continued)

*Primary Examiner* — Vivek K Shirsat

(74) *Attorney, Agent, or Firm* — Randall Danskin P.S.

(57) ABSTRACT

A collapsible camp stove having a cover, a chassis having a fuel burner and a pot support; and the pot support and the chassis and the cover are all pivotally interconnected to one another in a parallelogram structure wherein pivotal opening of the cover relative to the chassis causes the pot support to raise upwardly away from a top surface of the chassis while the pot support continuously remains parallel to the top surface of the chassis.

20 Claims, 24 Drawing Sheets

(56) References Cited

U.S. PATENT DOCUMENTS 3,062,127 A * 11/1962 Lang ..... A45F 3/46 99/393
3,117,568 A * 1/1964 Hoenisch ..... F24C 5/20 126/38
3,141,473 A * 7/1964 Mejyr ..... F16L 41/005 137/322
3,145,704 A * 8/1964 Broeck ..... F24C 3/14 126/38
3,294,079 A * 12/1966 Thompson ..... F24C 3/14 126/38
3,330,204 A * 7/1967 Little ..... A47J 37/0713 99/339
3,430,622 A * 3/1969 Locke ..... F24C 3/14 126/38
3,521,669 A * 7/1970 Suchowolec ..... G05D 16/0655 137/505.43
3,538,907 A * 11/1970 Bowman ..... A47J 37/0713 126/38
3,559,633 A * 2/1971 Born ..... F24C 3/14 126/38
3,687,125 A * 8/1972 Weimer ..... F24C 5/16 126/38
3,713,432 A * 1/1973 Finley ..... F24C 15/28 126/38
3,789,821 A * 2/1974 Fick ..... F24C 3/14 126/38
3,890,952 A * 6/1975 Hamre ..... F24C 5/06 126/45
3,903,867 A * 9/1975 Vestergaard ..... F24C 1/16 126/38
4,372,198 A * 2/1983 Stover, Jr ..... F24C 3/14 126/258
4,426,990 A * 1/1984 Shepherd ..... F24C 3/14 126/38
4,598,690 A * 7/1986 Hsu ..... F24C 1/16 126/25 R
4,848,310 A * 7/1989 Millington ..... F24C 3/14 126/4
5,203,317 A * 4/1993 James ..... A47J 37/0713 126/25 R
5,423,308 A * 6/1995 Huang ..... A47J 36/26 126/25 R
5,906,196 A * 5/1999 Measom ..... F24C 3/14 126/304 A
D417,359 S * 12/1999 Dutro ..... D7/332
6,079,400 A * 6/2000 Tomat Dany ..... F24C 3/14 126/37 B
6,089,218 A * 7/2000 Mifune ..... F17C 7/04 126/38
6,557,546 B1 * 5/2003 Gibbons ..... A47J 36/36 126/41 R
6,640,800 B1 * 11/2003 Hodgson ..... A47J 37/0713 126/25 R
8,082,914 B2 * 12/2011 Ip ..... F24C 3/085 126/9 R
10,174,952 B1 * 1/2019 King ..... A47J 37/0763
10,794,601 B1 * 10/2020 Sheehan ..... F24C 15/08
D932,823 S * 10/2021 Gauss ..... D7/337
2002/0050274 A1 * 5/2002 Hamilton ..... F24C 3/14 126/38
2002/0078943 A1 * 6/2002 Montgomery ..... F24C 3/14 126/38
2003/0010332 A1 * 1/2003 Mosher ..... F24C 3/14 126/38
2005/0241630 A1 * 11/2005 May ..... F24C 3/14 126/38
2006/0086351 A1 * 4/2006 Wilgus ..... A47J 37/0786 126/9 R
2006/0086354 A1 * 4/2006 Kahler ..... A47J 37/0786 126/337 R
2009/0272278 A1 * 11/2009 von Herrmann ..... F23D 14/16 99/450
2011/0094493 A1 * 4/2011 Malumyan ..... A47J 37/0763 126/25 R
2013/0032131 A1 * 2/2013 Horito ..... F24C 15/28 126/38
2013/0032138 A1 * 2/2013 Kihlstroem ..... F24C 15/12 126/9 R
2014/0069413 A1 * 3/2014 Galatte ..... A47J 37/0763 126/25 R
2014/0137850 A1 * 5/2014 Wylde ..... F24C 3/14 126/38
2014/0261377 A1 * 9/2014 Chung ..... A47J 37/0704 126/25 R
2014/0261393 A1 * 9/2014 Witzel ..... A47J 37/0713 126/9 B
2016/0356502 A1 * 12/2016 Hebert, Jr ..... B23P 19/04
2016/0370012 A1 * 12/2016 Chung ..... F23D 14/10
2018/0112882 A1 * 4/2018 Fleming ..... F24C 3/14
2018/0184844 A1 * 7/2018 Hagstrom ..... F24C 15/26
2020/0260910 A1 * 8/2020 Chung ..... A47J 37/0763
2020/0363068 A1 * 11/2020 Gauss ..... F24C 15/28

* cited by examiner

COLLAPSIBLE CAMP STOVE

RELATED APPLICATIONS

This Utility patent application claims priority to U.S. Provisional Patent Application Ser. No. 62/848,363 filed 15 May 2019, entitled "COLLAPSIBLE CAMP STOVE". The identified US Provisional patent application is fully and completely incorporated herein by this reference. Pursuant to the rules, this claim of priority is also being made in the Application Data Sheet (ADS) that is being concurrently submitted to the USPTO with the filing of this utility patent application.

The inventorship of this Utility patent application is the same as the inventorship of U.S. Provisional Patent Application Ser. No. 62/848,363 to which this Utility patent application claims priority.

TECHNICAL FIELD

This invention relates generally to stoves, and more particularly to gaseous fuel burning stoves that are used in outdoor activities such as camping, and even more particularly to collapsible camp stoves that are optionally configurable into a first storage/transport configuration, and into a second expanded/use configuration and wherein the first configuration is dimensionally smaller than the second configuration.

BACKGROUND OF THE INVENTION

Food is one of the necessities of life, and remains a necessity regardless of the activity a person is participating in.

Unless one cooks and prepares food over an open fire, a camp stove is necessary for outdoor activities where hot food is prepared/desired. When camping from a vehicle, or proximate thereto, the size/weight/dimension of a camp stove is not overly material. However, in outdoor activities, such as remote camping, and backpacking which have become more and more popular, and the outdoor enthusiast population is more accustomed to cooking and eating higher-quality meals, the need for high-quality, reliable, efficient and transportable camp stoves has increased.

In backpacking and similar outdoor activities, carrying a large camp stove is impractical, and may be impossible, because space and weight are critical issues of importance. Because known camp stoves, which are typically formed of metal, are both heavy, and space consuming, outdoor enthusiasts and backpacking enthusiasts have been forced to choose between cooking over open fires (which may be difficult and/or even prohibited depending on season and conditions), or forced to transport and use inadequate camp stoves.

There is a need for a collapsible camp stove that is compact while stored, yet is sufficiently large for ease of use, and when in use, is at least as large as current two burner propane camp stoves presently available.

Safety certifications (CSA and EU) require a defined spatial distance be maintained between the top of the stove burner to the bottom of a cooking vessel there over during use. This required spaced distance along with the thickness of the burner and the required ventilation (airspace envelope) of the stove encasement requires camp stoves to be a certain operational thickness (Z-axis). To achieve a reduction of this operational thickness, the primary air/fuel mixing tube can be positioned on a horizontal plane with the burner and the stove support can be mechanically controlled to change heights from the stored configuration to the use configuration.

Currently available stove burner designs, for camping use, domestic use, as well as heaters/furnaces, utilize a "ring-style" burner where environmental air (also known as secondary air) is maximized for the footprint of the burner by exposing the center of the burner to this secondary air supply. The added secondary air supply promotes complete combustion.

With regard to portable camp stove designs that reduce/minimize the Z-axis thickness of the camp stove in its stored configuration, there are known designs where the entire pot support is removed and inverted 180 degrees to "nest into" the water tray surrounding the burners. Clamshell designs where the pot support arms bi-pass each other as the camp stove (one burner on each side) fold together are also known.

However, such camp stoves are complex and small, and require multiple step manipulation to set up and operate, and also to collapse for transport. Such multiple step manipulation can be difficult in remote, cold and wet circumstances where a users fingers are less than nimble due to cold, moisture and/or exhaustion.

Therefore, there is a need for a camp stove which resolves at least some of the previously described drawbacks and provides a camp stove that is efficient for cooking, is lightweight, easily transportable, easily storable and does not require significant amounts of space. Thus, there remains a long felt an unmet need for a camp stove that is thermally efficient, easy to store, easy to transport, is lightweight, and has minimal dimensions.

SUMMARY OF THE INVENTION

A principal aspect of the present invention is to provide a collapsible camp stove comprising a cover, a chassis having a burner, a pot support and a water tray, and the pot support and the chassis and the cover are pivotally interconnected to one another in a parallelogram structure wherein pivotal opening and closing movement of the cover about a hinge relative to the chassis causes the pot support to move/raise upwardly away from a top surface of the water tray while the pot support continuously remains parallel to the top surface of the water tray and chassis.

A further aspect of the present invention is to provide a collapsible camp stove for controlled combustion of gaseous fuel comprising: a chassis having a water tray, a bottom panel, a first end cap, a second end cap, a pot support; and a fuel burner; the water tray is heat reflective and generally rectilinear in peripheral configuration, and has a top exterior surface, an opposing bottom interior surface, a front portion, a rear portion, a first lateral side portion having a first side flange, a second lateral side portion having a second side flange, and a front panel that defines cutouts for an igniter button and a control knob, and pivot leg cutouts, wind baffle locking slots, and burner cut-outs are defined in the top exterior surface, and a cover/rear pot support hinge second portion is structurally carried on the top exterior surface adjacent to the rear portion for pivotal interconnection with a cover/rear pot support hinge first portion carried by a cover; and the pot support has a front portion, a rear portion, a first lateral side portion, a second lateral side portion, a bottom, and a top, and the pot support is pivotally movable relative to the water tray on a first pivot arm, and a second pivot arm that are pivotally interconnected to the first and second lateral sides, proximate the front, and on rear pot support hinge portions carried by the cover proximate the rear portion so that the pot support moves in, and is maintained in, a continuously parallel orientation, and in parallelogram configuration relative to the water tray responsive to the cover being pivotally opened and closed relative to the chassis; and the first end cap and the second end cap form first and second side portions of the chassis and each has a recess, defined in a laterally inner side portion, to facilitate flush mounting the side flanges, of the water tray to the end caps, and angled fillets, are defined in the laterally inner side portion spacedly adjacent a bottom to facilitate non-flush mounting with bottom panel to prevent heat conduction from the bottom panel to the end caps, and two spaced apart leg end saddles are defined by each end cap, adjacent the bottom, to pivotally carry legs; and the bottom panel has a front edge, a rear edge, a first side, a second side, an exterior bottom surface, an interior top surface, and defines a plurality of spacedly arrayed air vents, and an angled side flange is carried at the first side, and at the second side, and each side flange is configured to engage with the adjacent end cap, in a non-flush mounting orientation so that a gap is maintained between each side flange and the adjacent end cap, to minimize heat conduction therebetween, and a fixed distance is maintained between the top interior surface of the bottom panel, and the bottom interior surface of the water tray so that air-flow is maintained therebetween; and the burner is carried adjacent above the bottom panel, and adjacent below the water tray, and aligned with burner cutout, and the burner is annular in configuration and has a fuel tube that extends radially outwardly from an outer circumferential edge, and a valve body is carried at a second end portion of the fuel tube spaced apart from the outer circumferential edge, and has an operator control knob positioned on the front panel for user access, and a fuel supply line communicates between a fuel port proximate the rear edge, and the valve body to supply fuel to the burner; and a cover is pivotally interconnected to the chassis and has an exterior top surface and an interior bottom surface and structurally carries a cover/rear pot support hinge first portion on the interior bottom surface adjacent a rear bottom edge to pivotally interconnect with a cover/rear pot support hinge second portion carried by the chassis, and the cover/rear pot support hinge first portion has a riser leg with a pot support saddle that is configured to rotatably engage with the pot support to move the pot support in an arc relative to the water tray and at a predetermined fixed distance from the water tray; and a length dimension of the riser leg of the cover/rear pot support hinge first portion, relative to a length dimension of the first and second pivot arms, maintains the top and bottom of the pot support in an orientation that is continuously parallel with the top surface of the water tray; and pivotal opening and closing of the cover relative to the chassis moves the pot support between a first position parallel to and immediately adjacent the water tray and a second position parallel to and spaced apart above from the water tray.

A further aspect of the present invention is to provide a collapsible camp stove that further comprises a wind baffle pivotally interconnected to a wind baffle hinge first portion carried at the first lateral edge bottom edge and at the second lateral edge bottom edge of the cover, and each wind baffle has a generally "L" configuration with a laterally exterior facing surface, a laterally interior facing surface, a hinge edge, a bottom edge having a position locking tab at an end portion opposite the hinge edge, and the hinge edge structurally carries a wind baffle hinge second portion that is configured to axially slide along a hinge pin carried by the wind baffle hinge first portion so that each wind baffle is both rotatably movable about the hinge pin and also axially movable along the hinge pin between a first folded in/retracted position and a second extended use position, and the laterally interior facing surface of each wind baffle has at least one pleat thereon that frictionally contacts the interior bottom surface of the cover when the wind baffle is in the first folded/retracted position to prevent adhesion to the cover interior bottom surface.

A further aspect of the present invention is to provide a collapsible camp stove that may also have magnet, which may be, but is not limited to, a neodymium magnet, carried by the cover at an edge portion to be magnetically attracted to a ferrous body carried by the chassis to magnetically positionally secure the cover in a closed orientation relative to the chassis.

A further aspect of the present invention is to provide a collapsible camp stove that further comprises a pot support lock that is carried in a notch defined in the second end cap laterally outer side portion proximate the front end portion, and the pot support lock has a laterally exterior facing surface that defines a finger grip, an opposing interior facing surface that carries a locking boss that releasably engages within a locking recess defined in the second pivot arm second end portion, and the pot support lock is biased by a spring, relative to the second end cap into a position for secure releasable engagement with the locking recess defined in the second pivot arm, and an arcuate camming surface extending partially about the second end portion of the second pivot arm facilitates frictional sliding engagement of the second end portion over the locking boss which forces the locking boss downwardly and overcoming the spring biasing as the second pivot arm rotates about pivot axle, and a lock cap, that is secured with fasteners positionally secures the spring and the pot support lock in the notch defined in the second end cap and maintains the positional biasing of the pot support lock toward the top portion of the second end cap and into engagement with the locking recess.

A further aspect of the present invention is to provide a collapsible camp stove that further comprises a fuel port hood pivotally carried by the bottom panel on a hinge adjacent to the fuel input port to pivot the fuel port hood downwardly relative to the bottom panel; and to prevent access to the fuel input port without prior deployment of the pivoting legs relative to the chassis.

A further aspect of the present invention is to provide a collapsible camp stove and wherein a thickness dimension of the collapsible camp stove, when in a collapsed transport configuration, from the top exterior surface of the cover, to the bottom exterior surface of the bottom panel is less than 50 mm, and more preferably is less than 45 mm, and even more preferably is less than 40 mm, and still more preferably is less than 37 mm, and even still more preferably is approximately 35 mm.

A further aspect of the present invention is to provide a collapsible camp stove and wherein the cover/rear pot support hinge first portion is structurally carried on the interior bottom surface of the cover adjacent to the rear bottom edge to pivotally interconnect with a cover/rear pot support hinge second portion carried by the chassis, and each cover/rear pot support hinge first portion has a pin barrel to axially receive a hinge pin therein, and has a riser leg extending distally from the pin barrel, the riser leg structurally carrying a generally "U" shaped pot support saddle at an edge portion opposite the pin barrel, and the pot support saddle is configured to engage with, and securely rotatably carry, a rear-most rail of the pot support, and the pot support saddle moves in an arc relative to the pin barrel and at a predetermined fixed distance from the pin barrel.

A further aspect of the present invention is to provide a collapsible camp stove and wherein the pot support bottom is parallel to, and immediately adjacent to, the top surface of the water tray when the cover is in a closed orientation relative to the chassis, and the pot support bottom is spaced apart from the top surface of the water tray a distance of 41 mm, and parallel to the top surface, when the cover is in an open orientation relative to the chassis.

A further aspect of the present invention is to provide a collapsible camp stove and wherein the first pivot arm is formed of a heat resistant material, is elongate and has a first end portion, a non-circular second end portion, a laterally exterior facing surface, a laterally interior facing surface, an axle hole defined in the first end portion, an axle hole defined in the second end portion with a length dimension therebetween, and the second end portion is radially enlarged to define an arcuate camming surface, a flat support surface and a corner portion, and the first end portion of the first pivot arm is pivotally interconnected to the first lateral side portion of the pot support spacedly adjacent the front portion on a pivot axle that extends through the axle hole and the noncircular second end portion is pivotally interconnected to a laterally inner side portion of the first end cap on a pivot axle that extends through the axle hole defined in the second end portion adjacent above a pivot arm boss carried by the first end cap so that the flat support service and corner portion frictionally and/or compressively rest upon the pivot arm boss when the cover is in an open orientation relative to the chassis.

A further aspect of the present invention is to provide a collapsible camp stove and wherein the second pivot arm is formed of a heat resistant material, is elongate and has a first end portion, a non-circular second end portion, a laterally exterior facing surface, a laterally interior facing surface, an axle hole defined in the first end portion, and an axle hole defined in the second end portion with a length dimension therebetween, and the second end portion is radially enlarged and defines a lock recess and an arcuate camming surface, and the first end portion is pivotally interconnected with the second lateral side portion of the pot support spacedly adjacent the front portion on a pivot axle that extends through the axle hole and the second end portion is pivotally interconnected to laterally inner side portion of the second end cap on a pivot axle that extends through the axle hole in the second end portion, adjacent above a spring biased pot support lock carried by the second end cap.

A further aspect of the present invention is to provide a collapsible camp stove and wherein the first end cap forms a first side portion to the chassis and has a front end portion, a rear end portion, a laterally outer side portion, a laterally inner side portion, a top and a bottom with a thickness dimension between the top and the bottom, and a recess is defined in the laterally inner side portion spacedly adjacent to the top to facilitate flush mounting with the first side flange of the water tray, and angled fillets are defined in the laterally inner side portion spacedly adjacent the bottom to facilitate non-flush mounting with the bottom panel to prevent heat conduction from the bottom panel to the first end cap, and a cover engaging boss is defined on the laterally inner side portion adjacent to the front end portion to operatively cooperate with the second end portion of the first pivot arm, and two spaced apart leg end saddles are defined on the laterally inner side portion, adjacent to the bottom to pivotally carry a pivotally movable leg, each leg end saddle having two spaced apart saddle engagement arms which define a saddle opening; and wherein the second end cap forms a second side portion to the chassis and the second end cap carries a pot support lock, the second end cap has a front end portion, a rear end portion, a laterally outer side portion, a laterally inner side portion, a top and a bottom with a thickness dimension between the top and the bottom, and a recess is defined in the laterally inner side portion spacedly adjacent to the top to facilitate flush mounting with the second side flange of the water tray, and angled fillets are defined in the laterally inner side portion spacedly adjacent to the bottom to facilitate non-flush mounting with the bottom panel to prevent heat conduction from the bottom panel to the second end cap, a cover engaging boss is defined on the laterally inner side portion adjacent to the front end portion, and two spaced apart leg end saddles are defined by the second end cap on the laterally inner side portion, adjacent to the bottom portion to releasably and pivotally carry pivotally movable legs, each leg end saddle having two spaced apart saddle engagement arms which define a saddle opening.

A still further aspect of the present invention is to provide a collapsible camp stove and wherein the collapsible camp stove has plural burners, and each burner has a burner body that is comprised of a burner body top portion, a burner body bottom portion, a fuel atomizer ring, a fuel diffuser ring, and a Venturi vane that affects air pressure and promotes fuel/air mixing is carried within the fuel tube, the atomizer ring and diffuser ring are carried between the top portion and the bottom portion, and a plurality of spacedly arrayed flame ports are defined in the top portion for gaseous fuel to pass outwardly there-from for combustion, a radially extending exterior flange extends circumferentially about the burner body and mounting holes are defined in the exterior flange to carry fasteners for securing the burner body to the interior top surface of the bottom panel proximate the front edge, and proximate the rear edge with burner brackets, so that the burner body is secured to the chassis at two spaced apart locations to float relative to the chassis to accommodate thermal expansion, a Piezo ignitor, operatively communicates with the igniter button, and is carried in a ignitor hood adjacent the outer circumferential edge of the burner body, and plural fuel exit holes are defined in the burner body adjacent to the ignitor hood to promote collection of the gaseous fuel within the hood and ignition of the gaseous fuel.

A still further aspect of the present invention is to provide a collapsible camp stove and wherein the water tray is metallic, heat reflective, generally rectilinear in peripheral configuration and has a generally planar top surface that defines a raised peripheral edge, an opposing bottom interior surface, a front portion, a rear portion, a first lateral side portion, a second lateral side portion, and a front panel that extends generally perpendicularly downwardly from the front portion, and the front panel defines plural spacedly arrayed cutouts for an igniter button and for a control knob, a first side flange at the first lateral side portion extends generally perpendicularly upwardly relative to the top surface, and a second side flange at the second lateral side portion extends generally perpendicularly upwardly relative to the top surface, and pivot leg cutouts, and wind baffle locking slots, are defined in the top surface spacedly adjacent to the first lateral side and spacedly adjacent to the second lateral side, and spaced apart from the front panel, and two spaced apart burner cutouts are defined in the top surface, each burner cutout has a peripheral edge that is angled upwardly opposite the bottom surface, and the cover/rear pot support hinge second portion is structurally carried on the top surface adjacent to the rear portion for pivotal interconnection with the cover/rear pot support hinge first portions carried by the cover.

An even still further aspect of the present invention is to provide a collapsible camp stove for controlled combustion of gaseous fuel comprising: a chassis; a cover pivotally interconnected to the chassis and; a gaseous fuel burner carried by the chassis; and the cover is generally rectilinear in peripheral configuration and has plural spacedly arrayed integral polyhedral bends to add rigidity, the cover has an exterior top surface, an interior bottom surface, a front edge portion, a rear edge portion, a first lateral edge portion, and a second lateral edge portion, and each of the edge portions extend, in the same direction, generally perpendicularly away from the exterior top surface and toward the interior bottom surface, and each of the edge portions has an upper edge portion adjacent the exterior top surface, and each has a lower edge portion spaced apart from the exterior top surface; a cover/rear pot support hinge first portion is structurally carried on the interior bottom surface of the cover adjacent to the rear bottom edge to pivotally interconnect with a cover/rear pot support hinge second portion carried by the chassis, each cover/rear pot support hinge first portion has a pin barrel to axially receive a hinge pin therein, and has a riser leg extending distally from the pin barrel, the riser leg structurally carrying a generally "U" shaped pot support saddle at an edge portion opposite the pin barrel, and the pot support saddle is configured to releasably engage with, and releasably and securely rotatably carry, a rear-most rail of pot support, and the pot support saddle moves in an arc relative to the pin barrel and at a predetermined fixed distance from the pin barrel; a wind baffle is pivotally interconnected to a wind baffle hinge first portion that is carried at the first lateral edge bottom edge and carried at the second lateral edge bottom edge of the cover, and each wind baffle has a generally "L" configuration with a laterally exterior facing surface, a laterally interior facing surface, a hinge edge, a bottom edge having a position locking tab at an end portion opposite the hinge edge, an upper edge that defines the "L" configuration, and the hinge edge structurally carries a wind baffle hinge second portion that is configured to axially slide along hinge pin carried by the wind baffle hinge first portion so that the wind baffle is both rotatably movable about the hinge pin and also axially movable along the hinge pin between a first folded in/retracted position and a second extended use position, and the laterally interior facing surface has at least one pleat thereon that frictionally contacts the interior bottom surface of the cover when the wind baffle is in the first folded/retracted position to prevent sticking to the cover interior bottom surface; the chassis is comprised of a water tray, a bottom panel, a first end cap, a second end cap, a pot support; and the gaseous fuel burner, the water tray is metallic, heat reflective, generally rectilinear in peripheral configuration and has a somewhat planar top surface that defines a raised peripheral edge, an opposing bottom interior surface, a front portion, a rear portion, a first lateral side portion, a second lateral side portion, and a front panel that extends generally perpendicularly downwardly from the front portion, and the front panel defines plural spacedly arrayed cutouts for an igniter button and a control knob, a first side flange at the first lateral side portion extends generally perpendicularly upwardly relative to the top surface, and a second side flange at the second lateral side portion extends generally perpendicularly upwardly relative to the top surface, and pivot leg cutouts, and wind baffle locking slots, are defined in the top surface spacedly adjacent to the first lateral side and to the second lateral side, and spaced apart from the front panel, and two spaced apart burner cutouts are defined in the top surface, each burner cutout has a peripheral edge that is angled upwardly opposite the bottom surface, and the cover/rear pot support hinge second portion is structurally carried on the top surface adjacent to the rear portion for pivotal interconnection with the cover/rear pot support hinge first portions carried by the cover; the pot support is generally planar and rectilinear and is formed of a plurality of spacedly arrayed and structurally interconnected rails, that are preferably formed of metal, and the pot support has a front portion, a rear portion, a first lateral side portion, a second lateral side portion, a bottom, and the top for supporting cooking vessels thereon, the pot support has a rearmost rail at the rear portion that operatively engages with the support saddle carried by the cover hinge/rear pot support first portion, and the pot support is pivotally interconnected to the chassis proximate the first end portion by a first pivot arm, and a second pivot arm so that the pot support moves in a continuously parallel orientation, and in parallelogram configuration relative to the chassis responsive to the cover being pivotally opened and closed relative to the chassis; the first pivot arm is formed of a heat resistant material, is elongate and has a first end portion, a non-circular second end portion, a laterally exterior facing surface, a laterally interior facing surface, an axle hole defined in the first end portion, an axle hole defined in the second end portion with a length dimension therebetween, and the second end portion is radially enlarged to define a curved camming surface, a flat support surface and a corner portion, and the first end portion is pivotally interconnected with the first lateral side portion of the pot support spacedly adjacent the front portion on a pivot axle that extends through the axle hole at the first end portion, and the noncircular second end portion is pivotally interconnected to, laterally inner side portion of the first end cap on a pivot axle that extends through the axle hole defined in the second end portion adjacent above a pivot arm boss carried by the first end cap so that the flat support service and corner portion frictionally rest upon the pivot arm boss when the cover is in an open orientation; the second pivot arm is formed of a heat resistant material, is elongate and has a first end portion, a non-circular second end portion, a laterally exterior facing surface, a laterally interior facing surface, an axle hole defined in the first end portion, and an axle hole defined in the second end portion with a length dimension therebetween, and the second end portion is radially enlarged and defines a lock recess and an arcuate camming surface, and the first end portion is pivotally interconnected with the second lateral side portion of the pot support spacedly adjacent the front portion on a pivot axle that extends through the axle hole in the first end portion, and the second end portion is pivotally interconnected to laterally inner side portion of the second end cap on a pivot axle 89 that extends through the axle hole in the second end portion, adjacent above a spring biased pot support lock carried by the second end cap; the first end cap is preferably of thermally resistant, and non-heat conductive material and forms a first side portion to the chassis and has a front end portion, a rear end portion, a laterally outer side portion, a laterally inner side portion, a top and a bottom with a thickness dimension between the top and the bottom, and a recess is defined in the laterally inner side portion spacedly adjacent to the top to facilitate flush mounting with the first side flange of the water tray, and angled fillets are defined in the laterally inner side portion spacedly adjacent the bottom to facilitate non-flush mounting with the bottom panel to prevent heat conduction from the bottom panel to the first end cap, a cover engaging boss is defined on the laterally inner side portion adjacent to the front end portion, and two spaced apart leg end saddles are defined by the first end cap on the laterally inner side portion, adjacent to the bottom to releasably and pivotally carry pivotally movable legs, each leg end saddle having two spaced apart saddle engagement arms which define a saddle opening; the second end cap is also preferably of thermally resistant, and non-heat conductive material and forms a second side portion to the chassis and the second end cap carries the pot support lock, the second end cap has a front end portion, a rear end portion, a laterally outer side portion, a laterally inner side portion, a top and a bottom with a thickness dimension between the top and the bottom, and a recess is defined in the laterally inner side portion spacedly adjacent to the top to facilitate flush mounting with the second side flange of the water tray, and angled fillets are defined in the laterally inner side portion spacedly adjacent to the bottom to facilitate non-flush mounting with the bottom panel to prevent heat conduction from the bottom panel to the second end cap, a cover engaging boss is defined on the laterally inner side portion adjacent to the front end portion, and two spaced apart leg end saddles are defined by the second end cap on the laterally inner side portion, adjacent to the bottom portion to releasably and pivotally carry pivotally movable legs, each leg end saddle having two spaced apart saddle engagement arms which define a saddle opening; and the pot support lock is movably carried in notch defined in the second end cap laterally outer side portion proximate the front end portion, and the pot support lock has a laterally exterior facing surface that defines a finger grip, an opposing interior facing surface that carries a locking boss that releasably engages within the locking recess defined in the second end portion of the second pivot arm, and the pot support lock is biased by a spring into a position for secure releasable engagement with the locking recess defined in the second pivot arm, and the arcuate camming surface facilitates frictional sliding engagement of the second end portion over the locking boss which forces the locking boss downwardly and overcoming the spring biasing as the second pivot arm rotates, and a lock cap, that is secured with fasteners positionally secures the spring and the pot support lock in the notch and maintains the positional biasing of the pot support lock toward the top portion of the second end cap and into engagement with the locking recess; and the bottom panel is generally planar and rectilinear in peripheral configuration and has a front edge, a rear edge, a first side, a second side, an exterior bottom surface, an interior top surface, and defines a plurality of spacedly arrayed air vents that are each angled upwardly toward the interior top surface, a leg storage recess is defined in the bottom panel spacedly adjacent the first side and spacedly adjacent the second side for storage of the pivoting legs, a finger ignition recess is defined in the bottom panel adjacent the front edge and aligned with the igniter button of the front panel, a fuel input port is defined in the rear edge, and a fuel port hood is pivotally carried on a hinge adjacent to the fuel input port to pivot the fuel port hood downwardly relative to the bottom panel, an angled side flange is carried at the first side, and at the second side, and each side flange is configured to engage with the adjacent end cap, in a non-flush orientation so that a gap is maintained between each side flange and the adjacent end cap, to minimize heat conduction therebetween, and a fixed distance is maintained between the top interior surface of the bottom panel, and the bottom interior surface of the water tray so that a space for air-flow is maintained therebetween; and two pivoting legs, each having a generally U-shaped configuration, and each having two opposing spaced apart end portions and a medial portion that is offset from the opposing end portions, each end portion is releasably, pivotally carried within the leg end saddles, of the second end cap and the first end cap, and each pivoting leg is positionally maintained relative to the bottom panel by a leg lock having a position securing flange that frictionally engages with the pivoting leg proximate to the end portion to positionally maintain the pivoting leg in an over center position that is angularly outward of vertical relative to the bottom panel; and two burners are carried by the chassis adjacent above the bottom panel, and adjacent below the water tray, and the burners are each aligned with burner cutout defined in the water tray, and each burner has a burner ring that is annular in configuration and defines a medial hole with an inner circumferential edge, and has a fuel tube that extends radially outwardly from an outer circumferential edge of the burner ring, the fuel tube has a first end portion adjacent to the burner ring, and a second end portion spaced apart from the burner ring with a medial channel therebetween for passage of gaseous fuel therethrough, and a valve body is carried at the second end portion, the valve body has an operator a control knob that is positioned on the front panel for user access, each burner further has a burner body that is comprised of a burner body top portion, a burner body bottom portion, a fuel atomizer ring, a fuel diffuser ring, and a Venturi vane that alters air pressure and promotes fuel/air mixing is carried within the fuel tube, the atomizer ring and diffuser ring are positioned medially between the top portion and the bottom portion, and a plurality of spacedly arrayed flame ports are defined in the top portion for gaseous fuel to pass outwardly there-from for combustion, a radially extending exterior flange extends circumferentially about the burner body and mounting holes are defined in the exterior flange to carry fasteners for securing the burner body to the interior top surface of the bottom panel proximate the front edge, and proximate the rear edge with burner brackets, so that the burner body is secured to the chassis at only two spaced apart locations to float relative to the chassis to accommodate thermal expansion, a Piezo ignitor, operatively communicates with the igniter button on the front panel, and is carried in a ignitor hood adjacent the outer circumferential edge of the burner body, and plural fuel exit holes are defined in the burner body adjacent to the ignitor hood to promote collection and ignition of the gaseous fuel, and a fuel supply line communicates between fuel port carried under the fuel port hood, and the valve body to supply the fuel to the burner, the fuel supply line is positionally secured to the interior top surface of the bottom panel by a fuel line securing bracket; and wherein the length dimension of the riser leg of the cover/rear pot support hinge first portion, relative to the length dimension of the first and second pivot arms, maintains the pot support in an orientation that is continuously parallel with the top surface of the water tray.

These and other aspects of the invention are set forth herein and in the detailed written description of the preferred embodiment that follows.

BRIEF DESCRIPTION OF THE DRAWINGS

Preferred embodiments of the invention are described, below, with reference to the following accompanying drawings.

DESCRIPTION OF THE PREFERRED EMBODIMENTS

This disclosure of the invention is submitted in furtherance of the Constitutional purposes of the U.S. Patent Laws "to promote the progress of science and useful arts" (Article 1, Section 8).

Figure 1:
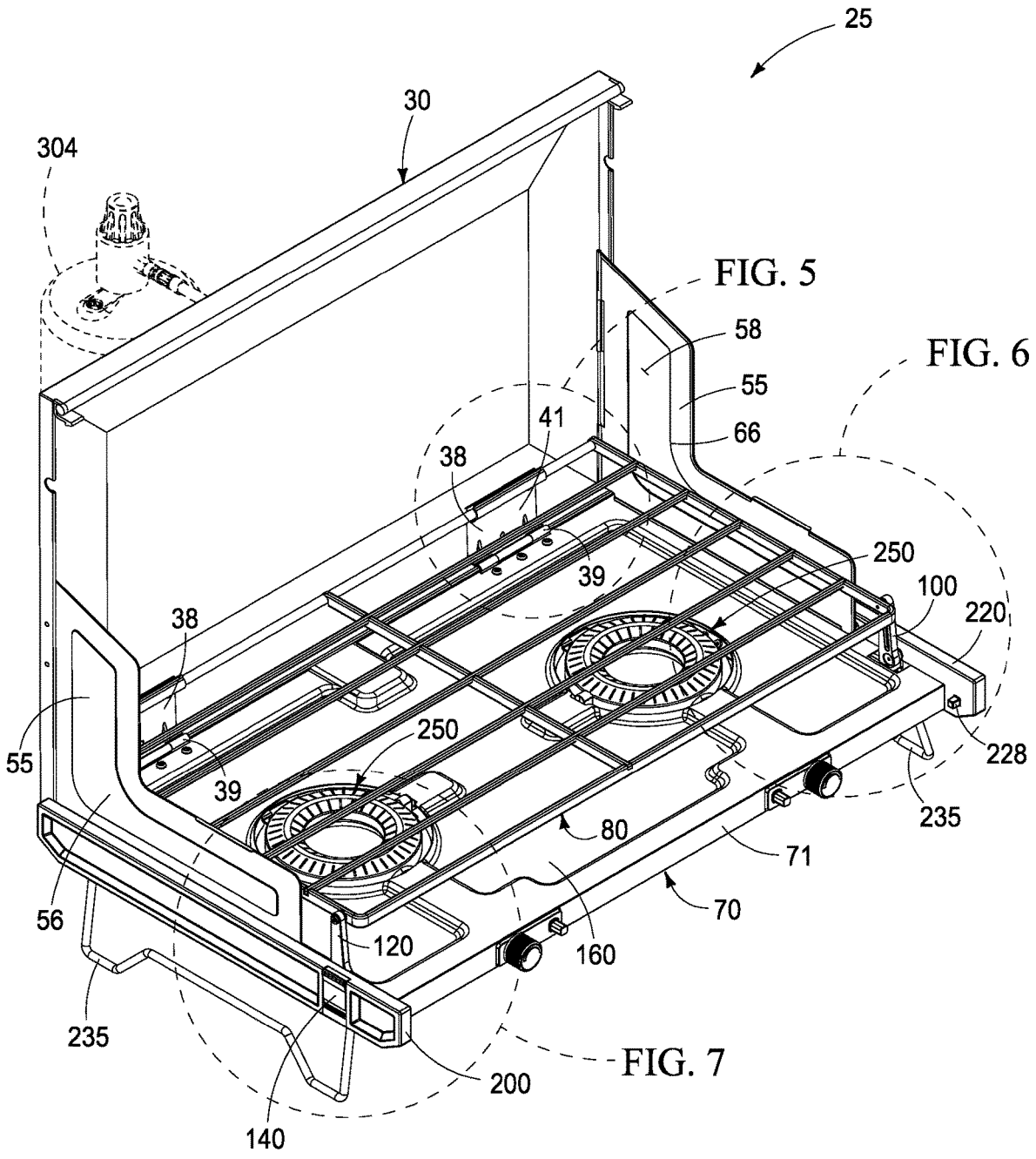
FIG. 1 is a perspective front, second side and top view of the collapsible camp stove in the expanded/open/use configuration with the wind baffles, and the pivoting legs extended.
Figure 19:
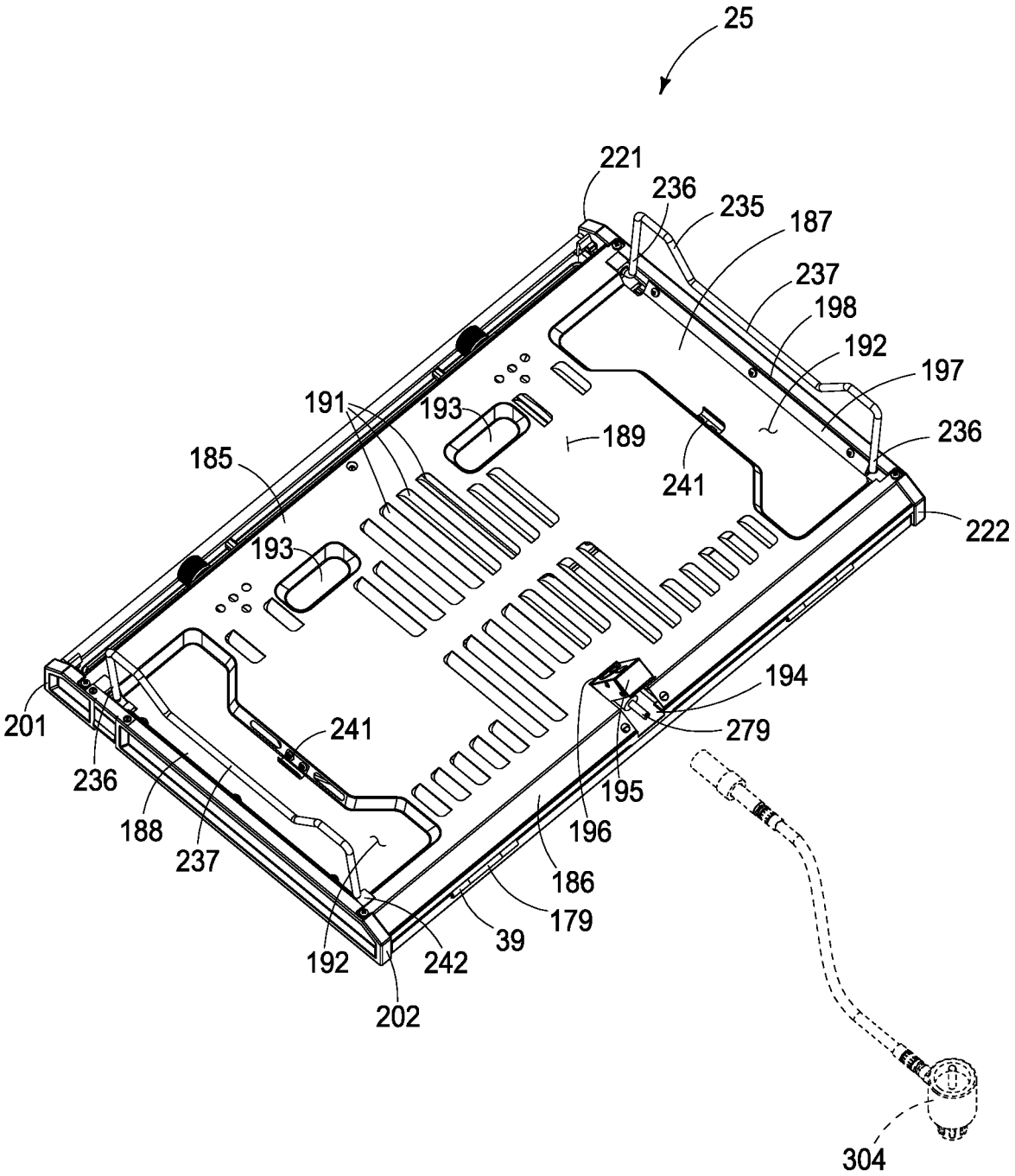
FIG. 19 is a perspective rear, bottom and second side view of the collapsible camp stove showing the details of the bottom panel.

A collapsible camp stove 25 for controlled combustion of gaseous fuel that is as thin as possible when stored in a first transport/collapsed/storage configuration (FIG. 19) and is full-sized when set up in a second expanded use configuration (FIG. 1) generally provides a chassis 70; a cover 30 pivotally interconnected to the chassis 70 and; a burner 250 carried by the chassis 70.

The cover 30 is generally rectilinear in peripheral configuration and has plural spacedly arrayed integral polyhedral bends 31 to add rigidity, the cover 30 has an exterior top surface 32, an interior bottom surface 33, a front edge portion 34, a rear edge portion 35, a first lateral edge portion 36, and a second lateral edge portion 37, and each of the edge portions 34, 35, 36, 37 extend, in the same direction, generally perpendicularly away from the exterior top surface 32 and toward the interior bottom surface 33, and each of the edge portions 34, 35, 36, 37 has an upper edge portion 34A, 35A, 36A, 37A adjacent the exterior top surface 32, and each has a lower edge portion 34B, 35B. 368, 37B spaced apart from the exterior top surface 32.

Figure 5:
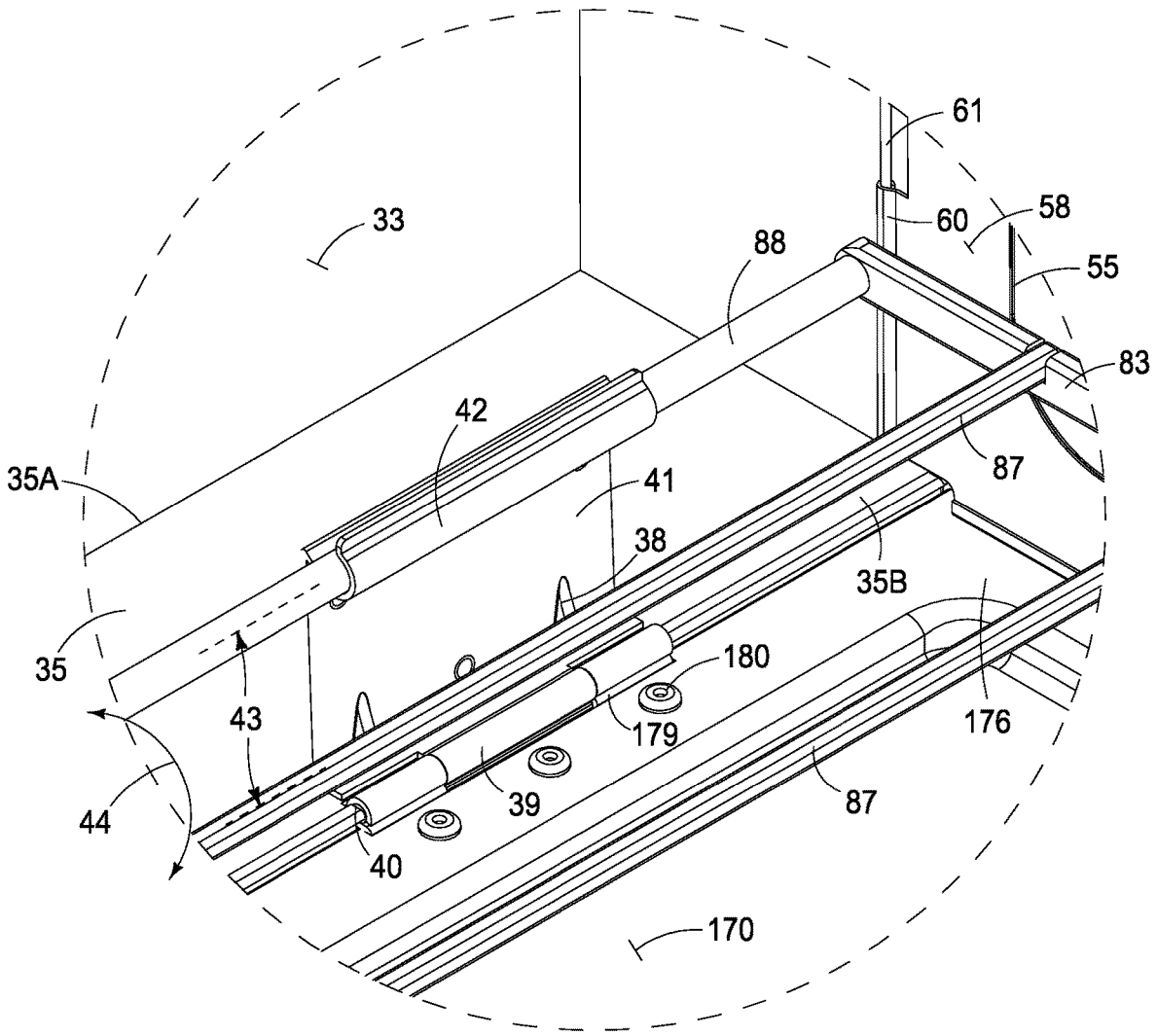
FIG. 5 is an enlarged view of a portion of FIG. 1 showing the details of the rear cover/pot support hinge and riser.

A cover/rear pot support hinge first portion 38 (FIG. 5) is structurally carried on the interior bottom surface 33 of the cover 30 adjacent to the rear bottom edge 358 to pivotally interconnect with a cover/rear pot support hinge second portion 179 carried by the chassis 70, each cover/rear pot support hinge first portion 38 has a pin barrel 39 to axially receive a hinge pin 40 therein, and has a riser leg 41 extending distally from the pin barrel 39, the riser leg 41 structurally carrying a generally "U" shaped pot support saddle 42 at an edge portion opposite the pin barrel 39, and the pot support saddle 42 is configured to releasably engage with, and releasably securely rotatably carry, a rear-most rail 88 of pot support 80, and the pot support saddle 42 moves in an arc 44 relative to the pin barrel 39 and at a predetermined fixed distance 43 from the pin barrel 39. The rear-most rail 88 of the pot support 80 may be disengaged from the pot support saddle 42 so as to pivot the pot support 80 rear portion 82 upwardly to allow cleaning of the bottom portion 86 and to allow cleaning of the top exterior surface 170 of the water tray 160 and to provide access to the burner 250.

Figure 2:
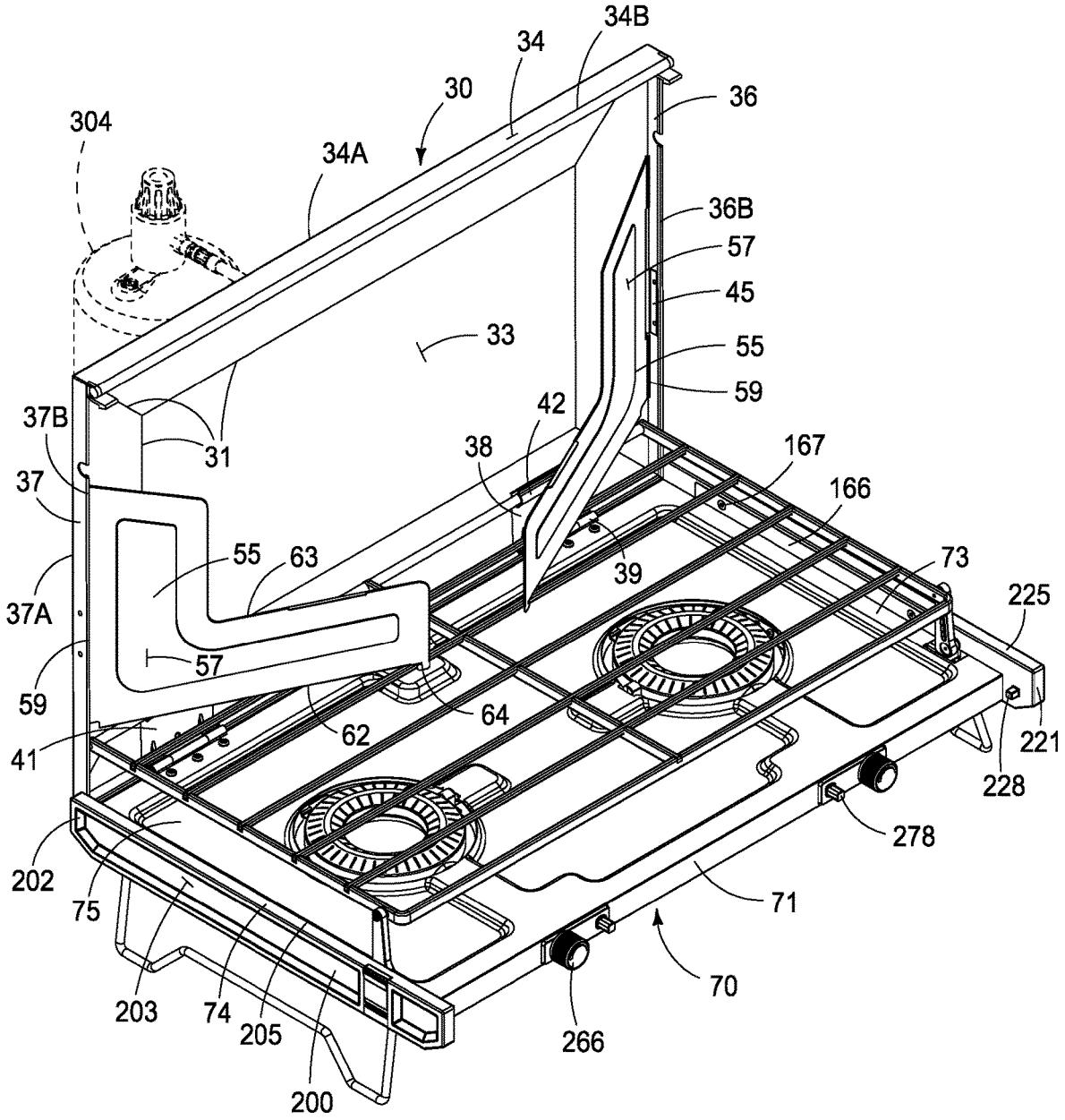
FIG. 2 is a perspective front, second side and top view, similar to that of FIG. 1 showing the wind baffles partially retracted toward the interior surface of the cover.
Figure 3:
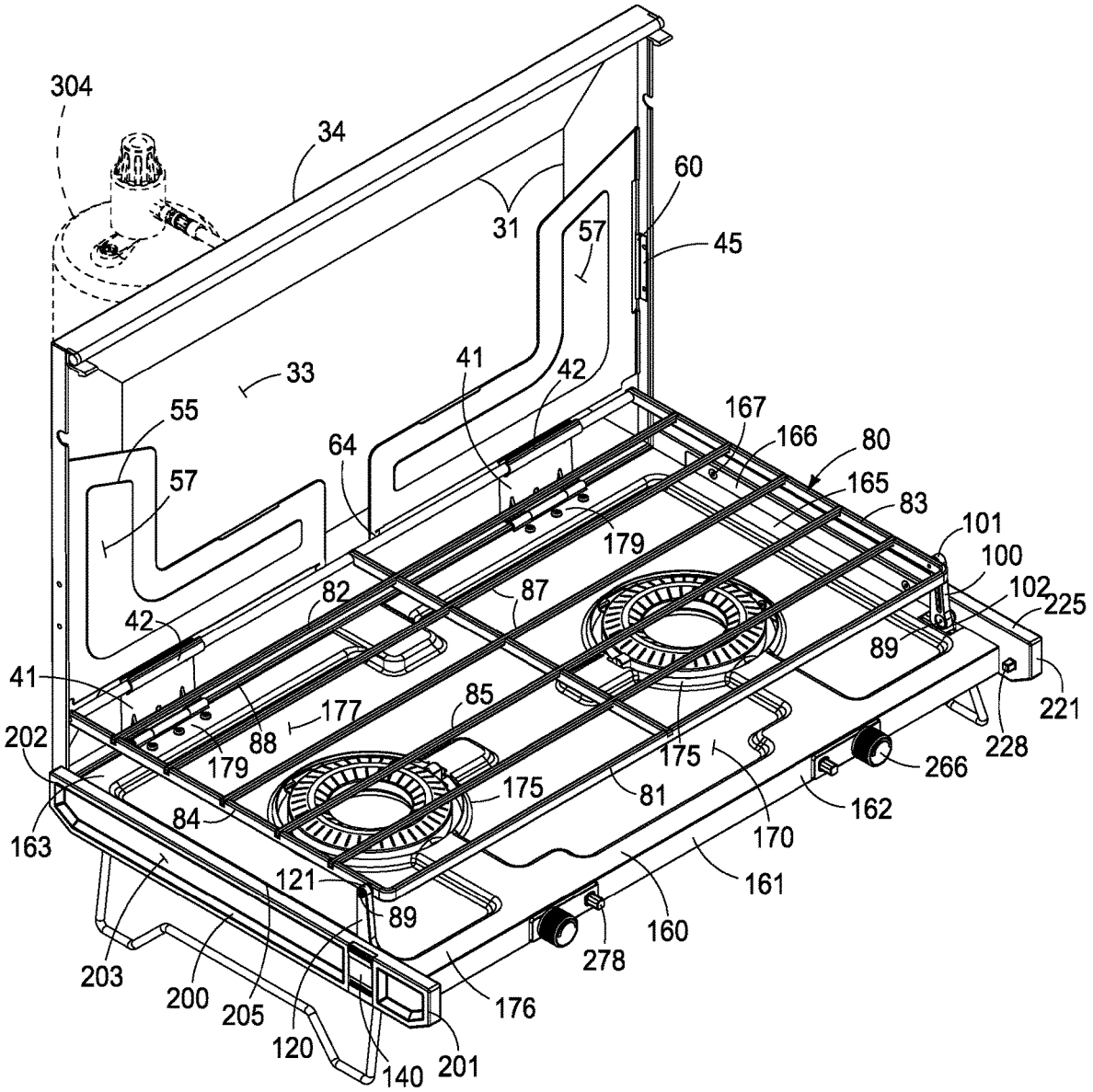
FIG. 3 is a perspective front, second side and top view similar to that of FIG. 2 showing the wind baffles fully retracted against the interior surface of the cover.
Figure 4:
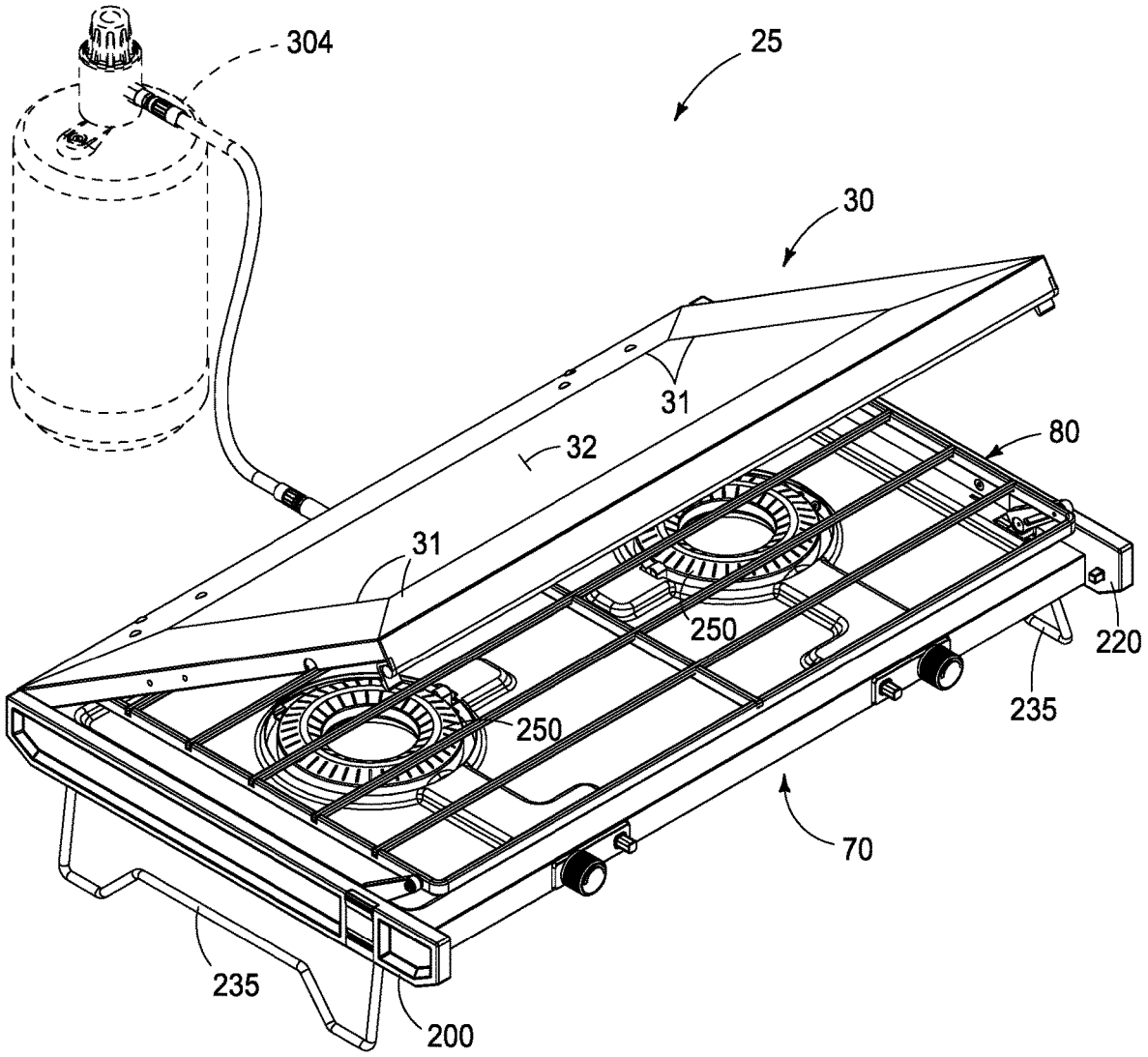
FIG. 4 is a perspective front, second side and top view similar to that of FIG. 1, showing the cover partially closed.

A wind baffle 55 (FIG. 2) is pivotally interconnected to a wind baffle hinge first portion 45 that is carried at the first lateral edge bottom edge 36B and carried at the second lateral edge bottom edge 37B of the cover 30, and each wind baffle 55 has a generally "L" configuration with a laterally exterior facing surface 57, a laterally interior facing surface 58, a hinge edge 59, a bottom edge 62 having a position locking tab 64 at an end portion opposite the hinge edge 59, an upper edge 63 that defines the "L" configuration, and the hinge edge 59 structurally carries a wind baffle hinge second portion 60 that is configured to axially slide along hinge pin 61 carried by the wind baffle hinge first portion 45 so that each wind baffle 55 is both rotatably movable about the hinge pin 61 and is also axially movable along the hinge pin 61 between a first folded in/retracted position (FIG. 3) and a second extended use position (FIG. 1), and the laterally interior facing surface 58 has at least one pleat 66 thereon that frictionally contacts the interior bottom surface 33 of the cover 30 when the wind baffle 55 is in the first folded/retracted position to prevent sticking to the cover 30 interior bottom surface 33.

In one contemplated embodiment, (FIG. 14) a magnet 46, such as, but not limited to a neodymium magnet, may be carried in the cover 30 at an edge portion 34, 36, 37 to be magnetically attracted to a ferrous body 47 carried in the chassis 70 to magnetically positionally secure the cover 30 in a closed orientation relative to the chassis 70.

The chassis 70 is comprised of a water tray 160, a bottom panel 184, a first end cap 220, a second end cap 200, a pot support 80; and the burner 250.

Figure 14:
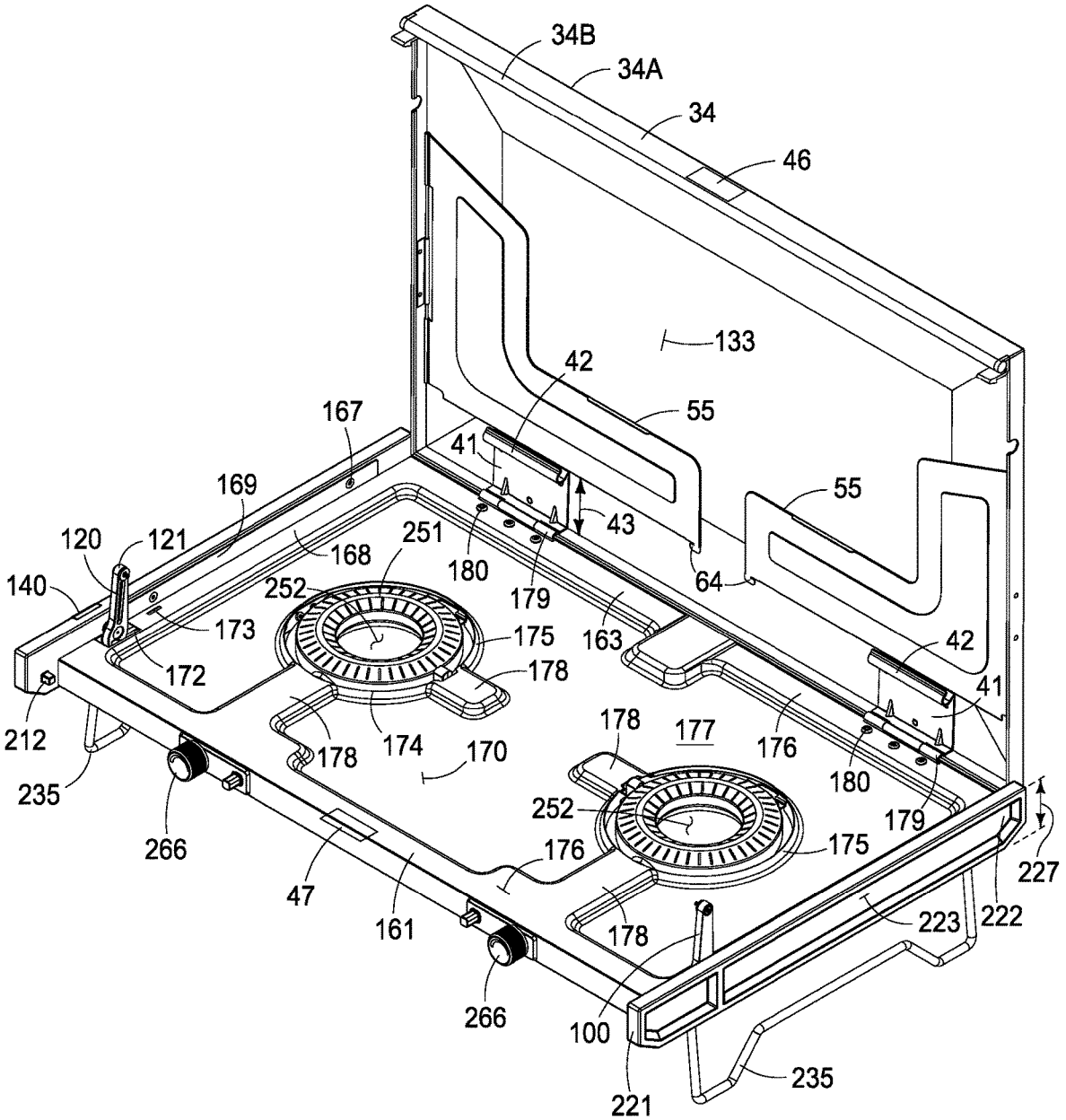
FIG. 14 is a front, first side and top view of the collapsible camp stove, less the pot support.

Best shown in FIG. 14, the water tray 160 is metallic, heat reflective, generally rectilinear in peripheral configuration and has a somewhat planar exterior top surface 170 that defines a raised peripheral edge 176, an opposing bottom interior surface 171, a front portion 161, a rear portion 163, a first lateral side portion 165, a second lateral side portion 168, and a front panel 162 that extends generally perpendicularly downwardly from the front portion 161, and the front panel defines plural spacedly arrayed cutouts 164 for an igniter button 278 and a control knob 266, a first side flange 166 at the first lateral side portion 165 extends generally perpendicularly upwardly relative to the top surface 170, and a second side flange 169 at the second lateral side portion 168 extends generally perpendicularly upwardly relative to the top surface 170, and pivot leg cutouts 172, and wind baffle locking slots 173, are defined in the top surface 170 spacedly adjacent to the first lateral side 165 and to the second lateral side 168, and spaced apart from the front panel 162, and two spaced apart burner cutouts 174 are defined in the top surface 170, each burner cutout 174 has a peripheral edge 175 that is angled upwardly opposite the bottom interior surface 171, and the cover/rear pot support hinge second portion 179 is structurally carried on the top surface 170 adjacent to the rear portion 163 for pivotal interconnection with the cover/rear pot support hinge first portions 38 carried by the cover 30.

The pot support 140 is generally planar and rectilinear and is formed of a plurality of spacedly arrayed and structurally interconnected rails 87, that are preferably formed of metal, and the pot support 140 has a front portion 81, a rear portion 82, a first lateral side portion 83, a second lateral side portion 84, a bottom 86, and the top 85 for supporting cooking vessels thereon, the pot support 140 has a rearmost rail 88 at the rear portion 82 that operatively engages with the support saddle 42 carried by the cover hinge/rear pot support first portion 38, and the pot support 140 is pivotally interconnected to the chassis 70 at the first and second lateral sides 83, 84, proximate the first end portion 81 by a first pivot arm 100, and a second pivot arm 120 so that the pot support 140 moves in a continuously parallel orientation, and in parallelogram configuration relative to the chassis 70 responsive to the cover 30 being pivotally opened and closed relative to the chassis 70.

Figure 6:
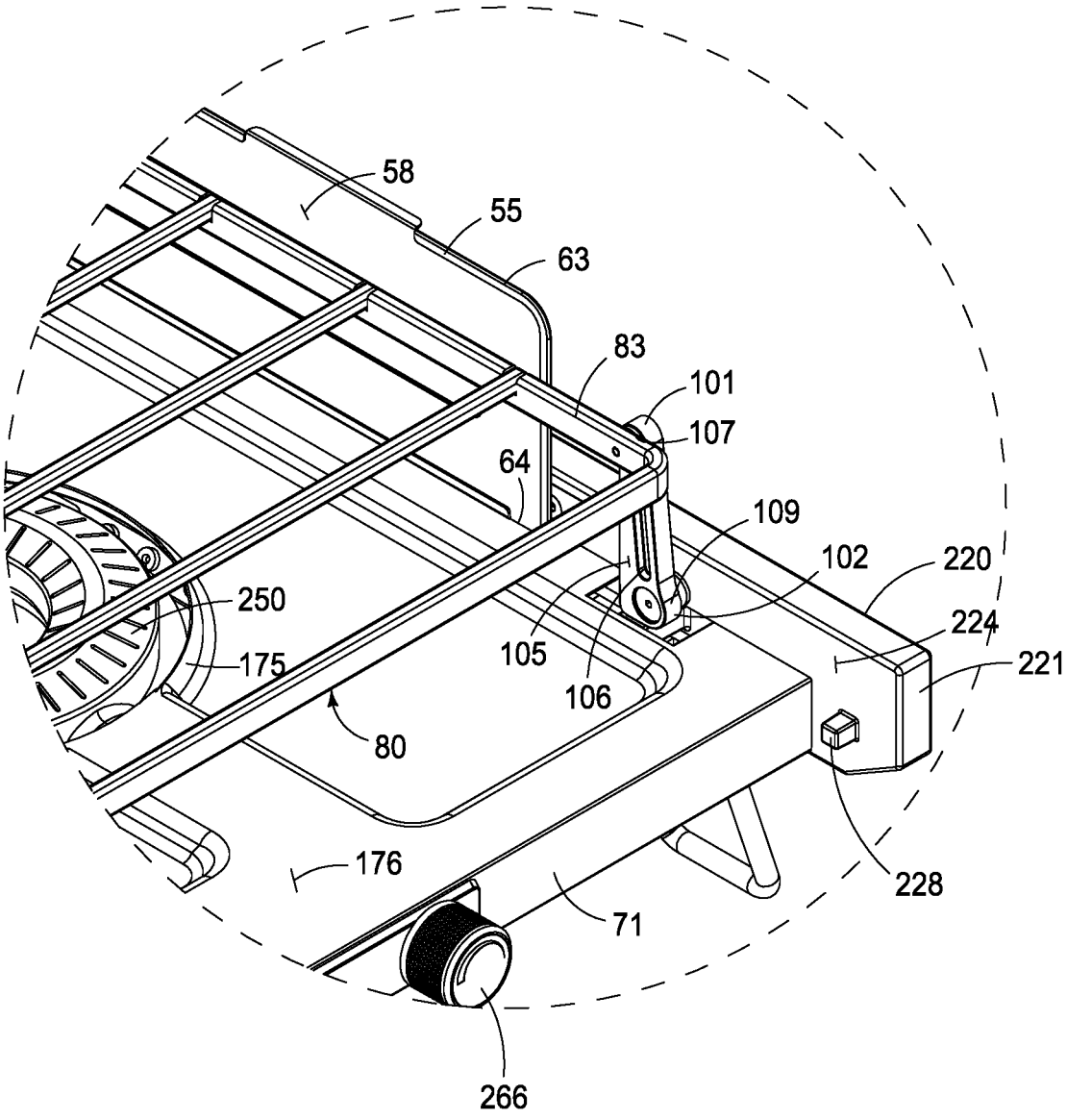
FIG. 6 is an enlarged view of a portion of FIG. 1 showing the details of the first pivot arm.
Figure 7:
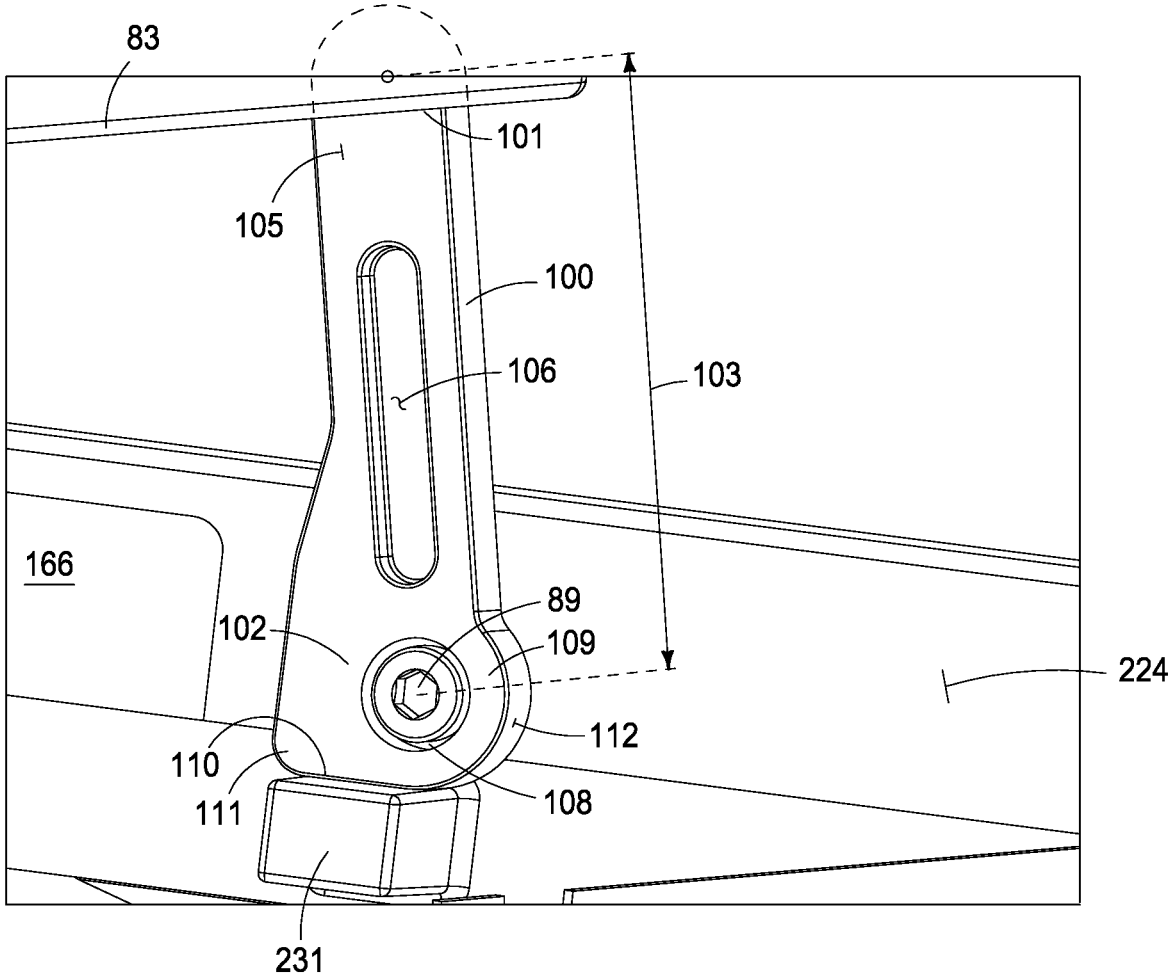
FIG. 7 is an enlarged perspective view of a laterally interior side of the first pivot arm.
Figure 8:
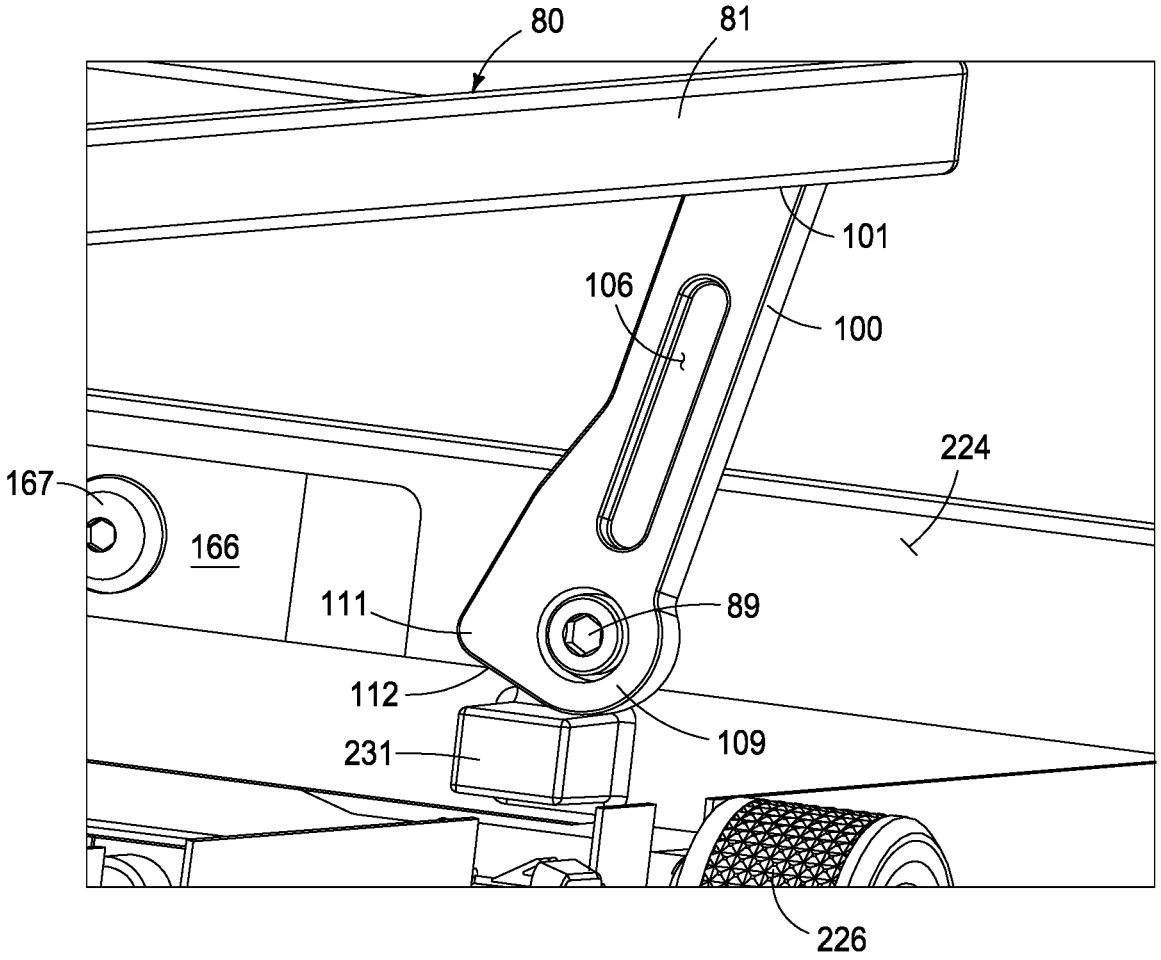
FIG. 8 is an enlarged perspective view, similar to that of FIG. 7 showing the first pivot arm partially pivoted.

Best shown in FIGS. 6, 7 and 8, the first pivot arm 100 is formed of a heat resistant material, is elongate and has a first end portion 101, a non-circular second end portion 102, a laterally exterior facing surface 104, a laterally interior facing surface 105, an axle hole 107 defined in the first end portion 101, an axle hole 108 defined in the second end portion 102 with a length dimension 103 therebetween, and the second end portion 102 is radially enlarged to define a curved camming surface 112, a flat support surface 110 and a corner portion 111, and the first end portion 101 is pivotally interconnected with the first lateral side portion 83 of the pot support 80 spacedly adjacent the front portion 81 on a pivot axle 89 that extends through the axle hole 107, and the noncircular second end portion 102 is pivotally interconnected to the laterally inner side portion 224 of the first end cap 220 on a pivot axle 89 that extends through the axle hole 108 defined in the second end portion 102 adjacent above a pivot arm boss 231 carried by the first end cap 220 so that the flat support service 110 and corner portion 111 frictionally and/or compressively rest upon the pivot arm boss 231 when the cover 30 is in an open orientation. The boss 231 and corner 111 provide a pivot rotation stop/limiter for the pivot arm 100 and responsively, for the cover 30

Figure 9:
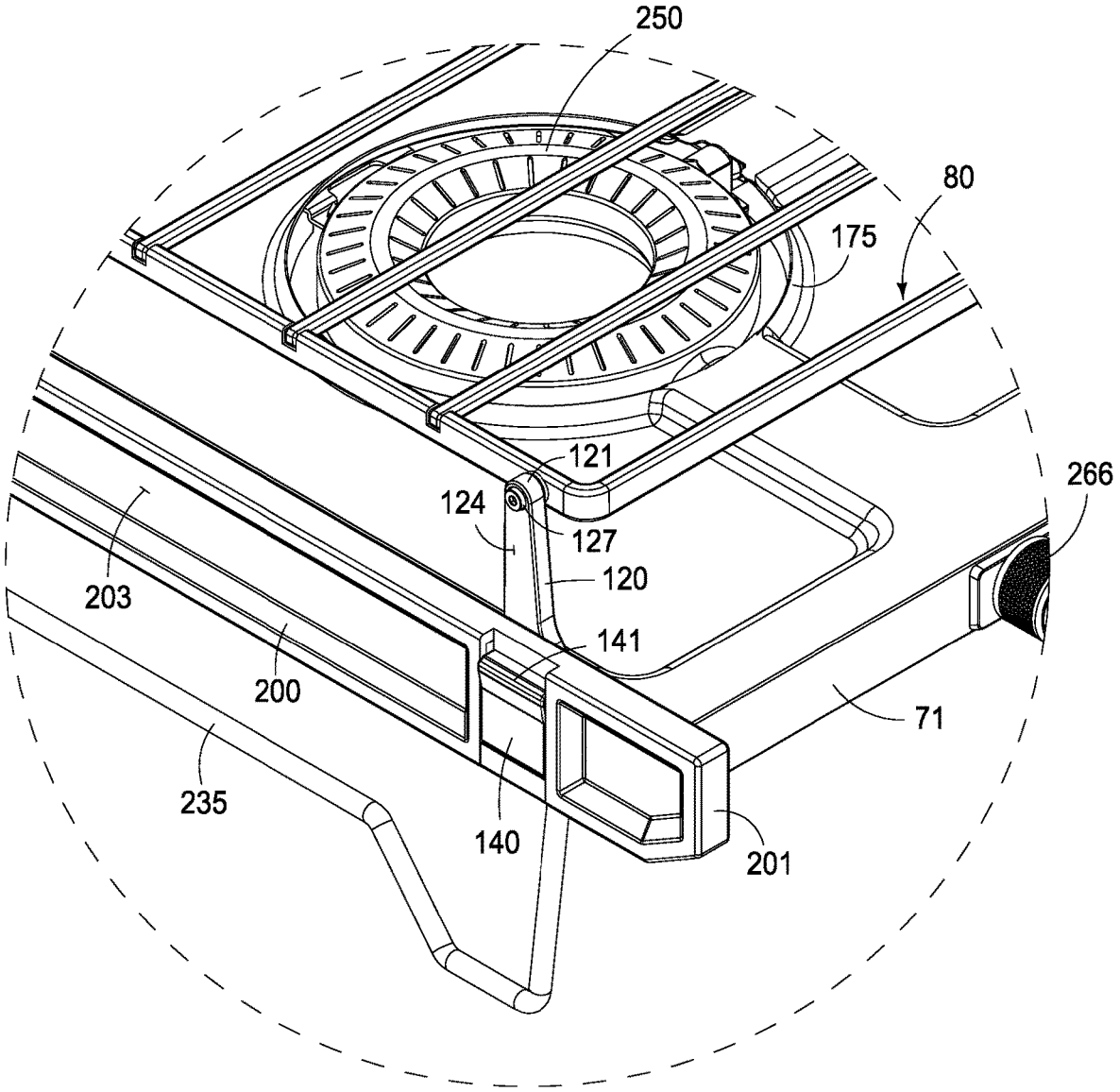
FIG. 9 is an enlarged perspective view of the second end cap, the pot support lock and the second pivot arm.
Figure 11:
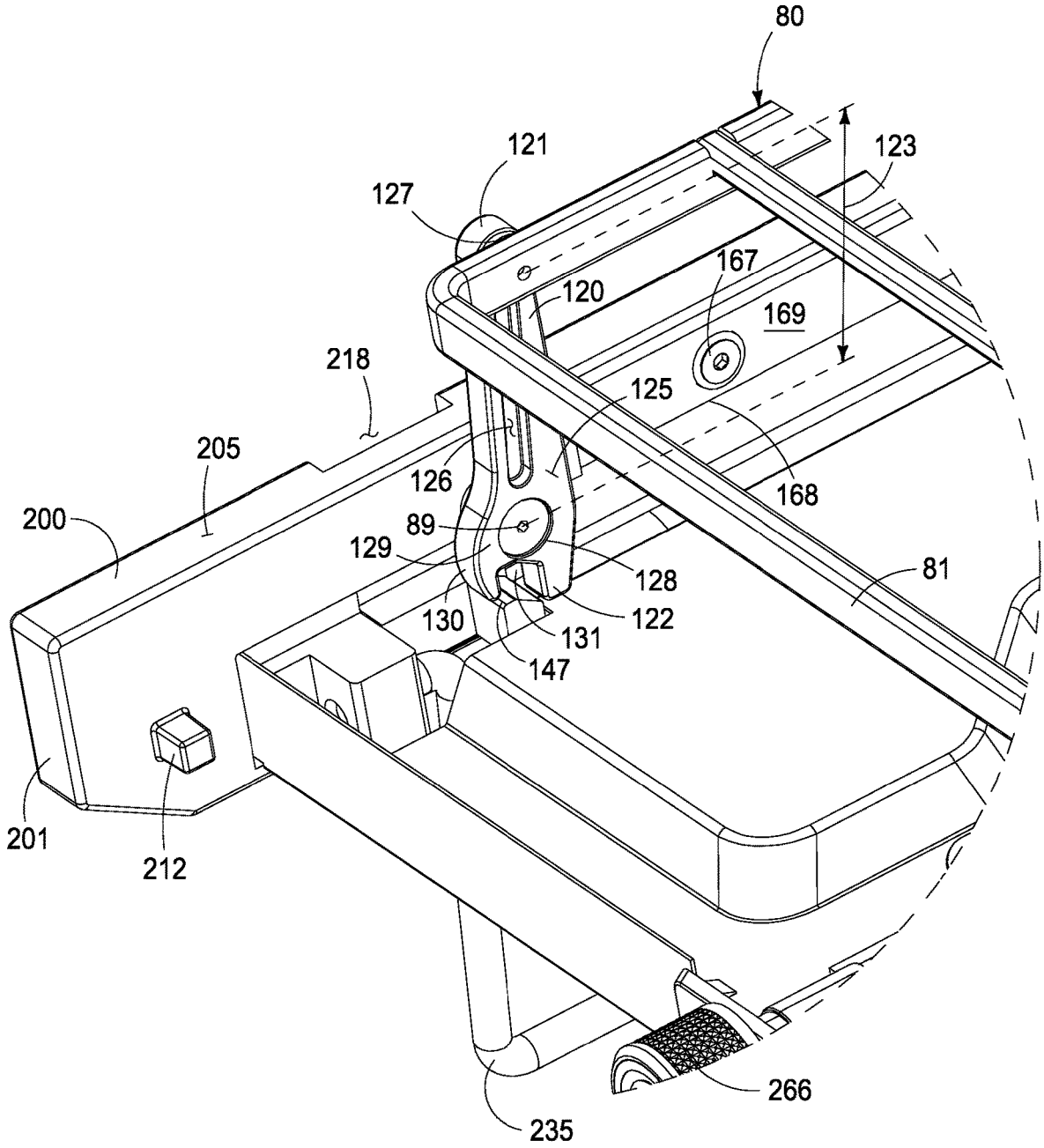
FIG. 11 is an enlarged, partial cutaway view of the second pivot arm and the pot support lock.
Figure 12:
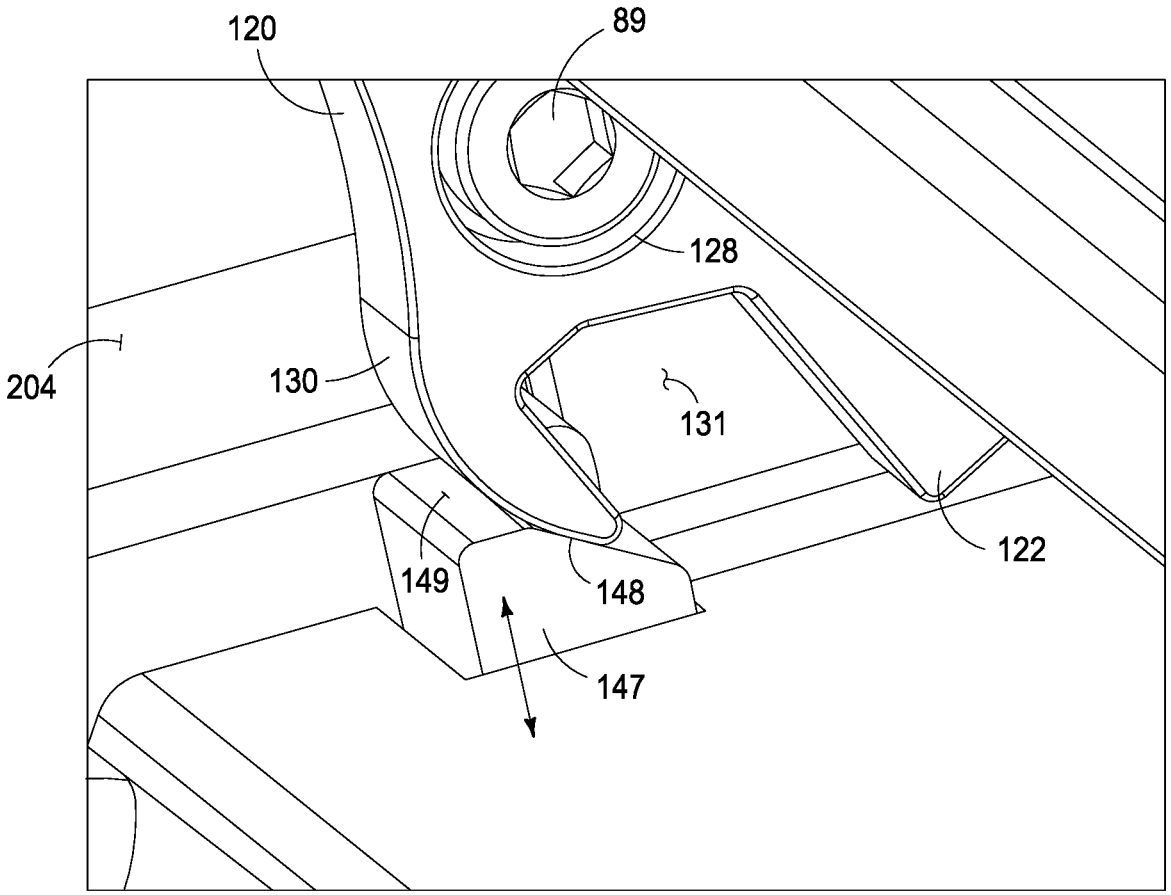
FIG. 12 is an enlarged view of the second end portion of the second pivot arm and the spring biased locking boss.

The second pivot arm 120 (FIGS. 9, 11, 12) is formed of a heat resistant material, is elongate and has a first end portion 121, a non-circular second end portion 122, a laterally exterior facing surface 124, a laterally interior facing surface 125, an axle hole 127 defined in the first end portion 121, and an axle hole 128 defined in the second end portion 122 with a length dimension 123 therebetween, and the second end portion 122 is radially enlarged and defines a lock recess 131 and an arcuate camming surface 130, and the first end portion 121 is pivotally interconnected with the second lateral side portion 84 of the pot support 80 spacedly adjacent the front portion 81 on a pivot axle 89 that extends through the axle hole 127, and the second end portion 122 is pivotally interconnected to laterally inner side portion 204 of the second end cap 200 on a pivot axle 89 that extends through the axle hole 128 in the second end portion 122, adjacent above a spring biased lock boss 147 of a pot support lock 140 carried by the second end cap 200.

Figure 13:
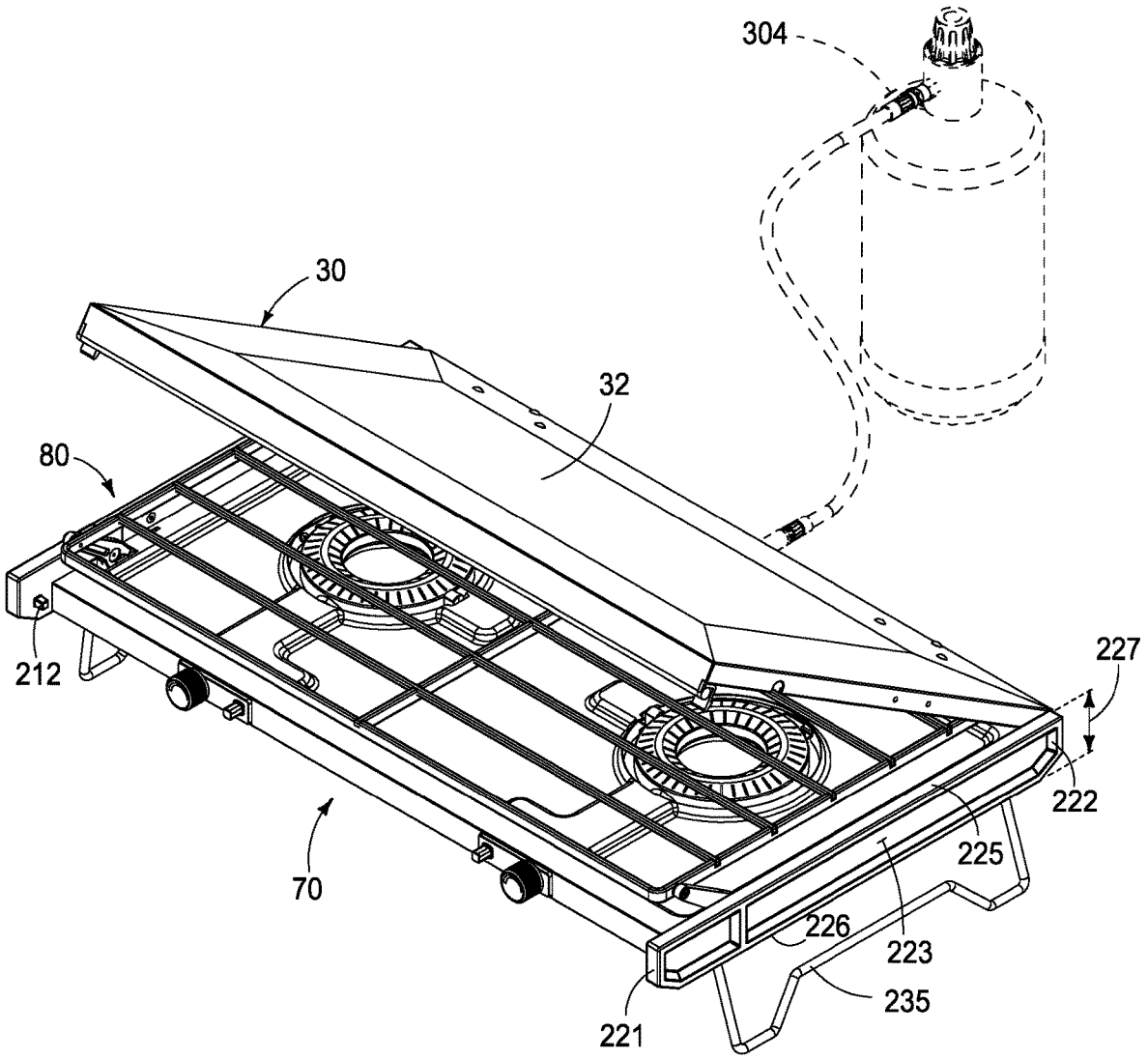
FIG. 13 is a perspective front, first side and top view of the collapsible camp stove, similar to that of FIG. 4, showing the cover pivoted to a partially closed position.

The first end cap 220 (FIGS. 13, 14) is preferably formed of thermally resistant, and non-heat conductive material and forms a first side portion to the chassis 70 and has a front end portion 221, a rear end portion 222, a laterally outer side portion 223, a laterally inner side portion 224, a top 225 and a bottom 226 with a thickness dimension 227 between the top 225 and the bottom 226. A recess 229 is defined in the laterally inner side portion 223 spacedly adjacent to the top 225 to facilitate flush mounting with the first side flange 166 of the water tray 160. An insulating washer (not shown) is positioned between the end cap 220 and the side flange 166 to minimize conductive heat transfer to the end cap 220. Angled fillets 230 are defined in the laterally inner side portion 223 spacedly adjacent the bottom 226 to facilitate non-flush mounting with the bottom panel 184 to minimize heat conduction from the bottom panel 184 to the first end cap 220. Insulating washers (not shown) are positioned between the angled fillets 230 and the bottom panel 184 as well. A cover engaging boss 228 is defined on the laterally inner side portion 224 adjacent to the front end portion 221, and two spaced apart leg end saddles/bosses 232 are defined by the first end cap 220 on the laterally inner side portion 224, adjacent to the bottom 266 to releasably and pivotally carry pivotally movable legs 235. Each leg end saddle/boss 232 has two spaced apart saddle engagement arms 233 which define a saddle opening 234, or a hole (not shown) to carry an end portion of the pivotally movable leg 235.

Figure 10:
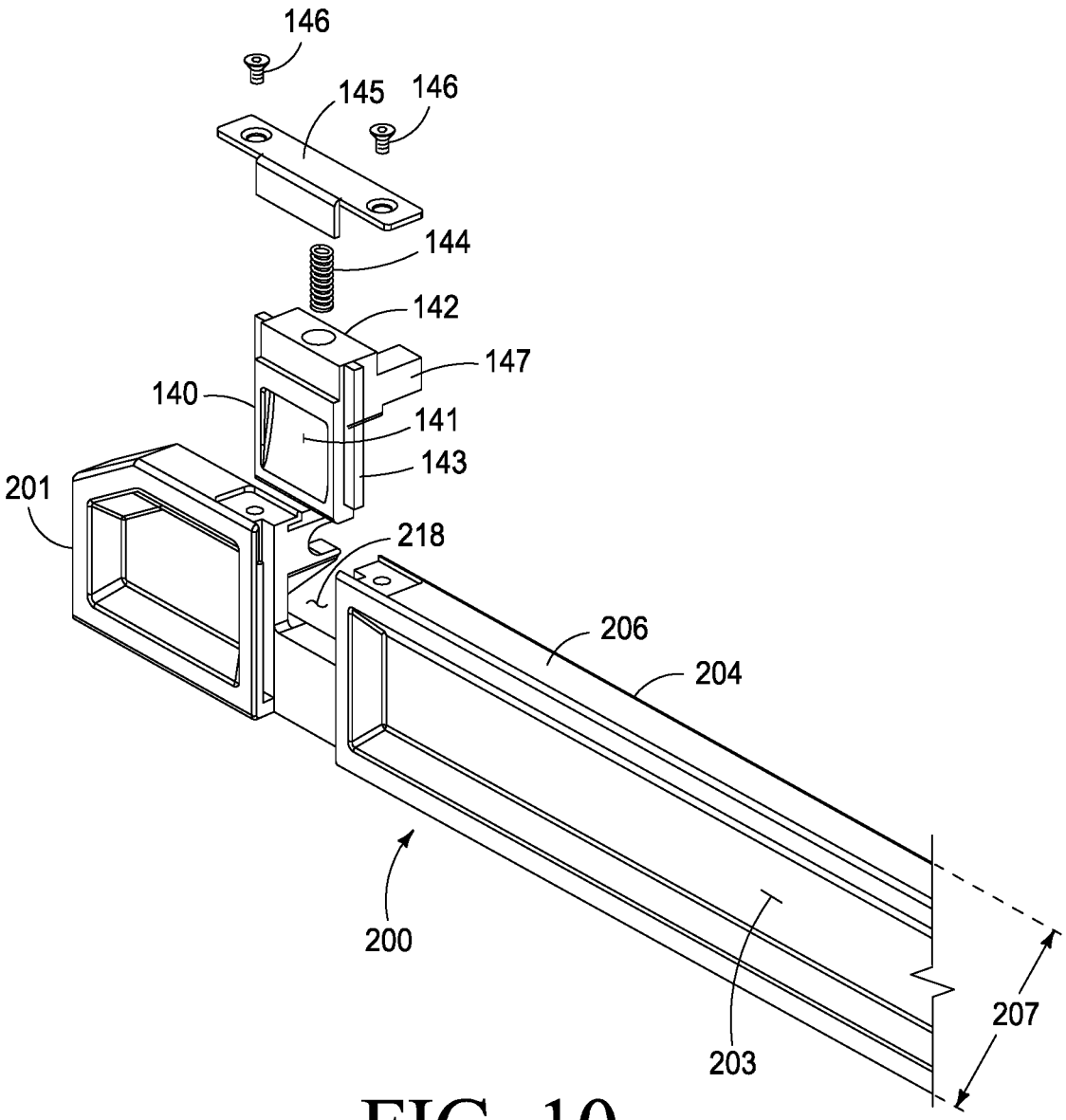
FIG. 10 is a perspective exploded view of the pot support lock and the bottom surface of the second end cap.

The second end cap 200 (FIGS. 9, 10) is also preferably formed of thermally resistant, and non-heat conductive material and forms a second side portion to the chassis 70 and the second end cap 200 carries the pot support lock 140. The second end cap 200 has a front end portion 201, a rear end portion 202, a laterally outer side portion 203, a laterally inner side portion 204, a top 205 and a bottom 206 with a thickness dimension 207 between the top 205 and the bottom 206. A recess 213 is defined in the laterally inner side portion 203 spacedly adjacent to the top 205 to facilitate flush mounting with the second side flange 169 of the water tray 160. An insulating washer (not shown) is positioned between the end cap 200 and the side flange 169 to minimize conductive heat transfer to the end cap 200. Angled fillets 214 are defined in the laterally inner side portion 203 spacedly adjacent to the bottom 206 to facilitate non-flush mounting with the bottom panel 184 to minimize heat conduction from the bottom panel 184 to the second end cap 200. Insulating washers (not shown) are positioned between the angled fillets 214 and the bottom panel 184 as well. A cover engaging boss 212 is defined on the laterally inner side portion 204 adjacent to the front end portion 201, and two spaced apart leg end saddles/bosses 215 are defined by the second end cap 200 on the laterally inner side portion 204, adjacent to the bottom portion 206 to releasably and pivotally carry pivotally movable legs 235. Each leg end saddle/boss 215 may have two spaced apart saddle engagement arms 216 which define a saddle opening 217, or the saddle/boss 215 may define a hole (not shown) to carry an end portion of the pivotally movable leg 235.

The pot support lock 140 (FIGS. 9, 10) is movably carried in notch 218 defined in the second end cap 200 laterally outer side portion 203 proximate the front end portion 201. The pot support lock 140 has a laterally exterior facing surface 141 that defines a finger grip, an opposing interior facing surface 142 that carries a locking boss 147 that releasably engages within the locking recess 131 defined in the second end portion 122 of the second pivot arm 120. The pot support lock 140 is biased by spring 144 into a position for secure releasable engagement with the locking recess 131 defined in the second pivot arm 130, and the arcuate camming surface 130 facilitates frictional sliding engagement of the second end portion 122 over the locking boss 147 which forces the locking boss 147 downwardly (overcoming the spring biasing) as the second pivot arm 120 rotates (responsive to movement of the cover 30). A lock cap 145, that is secured with fasteners 146 positionally secures the spring 144 and the pot support lock 140 in the notch 218 and maintains the positional biasing of the pot support lock 140 toward the top portion 205 of the second end cap 200 and into engagement with the locking recess 131.

Figure 15:
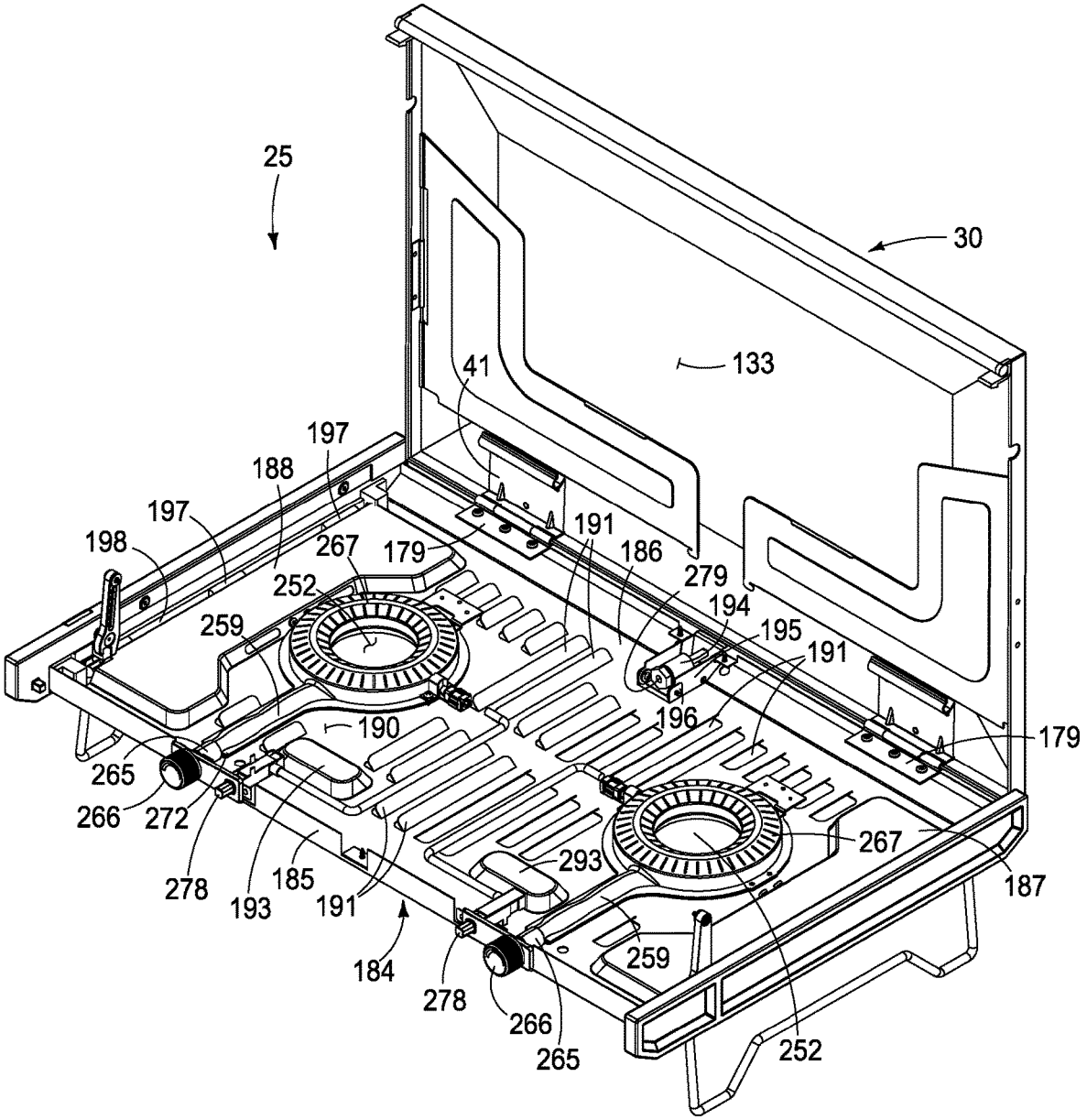
FIG. 15 is a front, first side and top view of the collapsible camp stove, similar to that of FIG. 14, less the water tray.

The bottom panel 184 (FIGS. 15, 19) is generally planar and rectilinear in peripheral configuration and has a front edge 185, a rear edge 186, a first side 187, a second side 188, an exterior bottom surface 189, an interior top surface 190, and defines a plurality of spacedly arrayed air vents 191 that are each angled upwardly toward the interior top surface 190 and into space 300 between the interior top 190 of the bottom panel 184 and the interior bottom 171 of the water tray 160. The angulation of the air vents 191 is approximately 40° off vertical. The angulation of the air vents 191 reflects downward radiant heat from the burners 250 so as to prevent an underlying supporting surface, such as a table, (not shown) from being damaged, and further the angulation adds stiffness and rigidity to the bottom panel 184. A leg storage recess 192 is defined in the bottom panel 184 spacedly adjacent the first side 187 and spacedly adjacent the second side 188 for storage of the pivoting legs 235 therein. A finger ignition recess 193 is defined in the bottom panel 184 adjacent the front edge 185 and aligned with the igniter button 278 of the front panel 162 to allow a user to grip the bottom panel 184 while depressing the igniter button 278. A fuel input port 194 is defined in the rear edge 186, and a fuel port hood 195 is pivotally carried on a hinge 196 adjacent to the fuel input port 194. The fuel port hood 195 pivots downwardly relative to the bottom panel 184, and when closed obstructs access to the fuel input port 194. Only when the fuel port hood 195 is opened (pivoted downwardly) does a user have access to the fuel input port 194 for connection to a fuel reservoir 304. The orientation operation of the hood 195 provides safety because the input port 194 is close to the supporting surface (not shown) (low in height), and cannot be accessed for use unless the pivoting legs 235 are deployed relative to the chassis 70 and the bottom panel 164. If, the collapsible camp stove 25 were operated directly upon a supporting surface (not shown) without deployment of the pivoting legs 235, heat from the burners 250 could be communicated to the supporting surface (not shown) through the plurality of vents 191 which might damage the supporting surface (not shown) and even cause the supporting surface (not shown) to ignite. An angled side flange 197 is carried at the first side 187, and at the second side 188, and each side flange 197 is configured to engage with the adjacent end cap 200, 220 in a non-flush orientation using an insulating washer (not shown) therebetween, so that a gap 198 is maintained between each side flange 197 and the adjacent end cap 200, 220 to minimize heat conduction therebetween. A fixed distance 300 is maintained between the top interior surface 190 of the bottom panel 184, and the bottom interior surface 171 of the water tray 160 so that a space for air-flow to promote efficient and complete combustion is maintained therebetween, and conduction of heat from the burner 250 is minimized.

Figure 20:
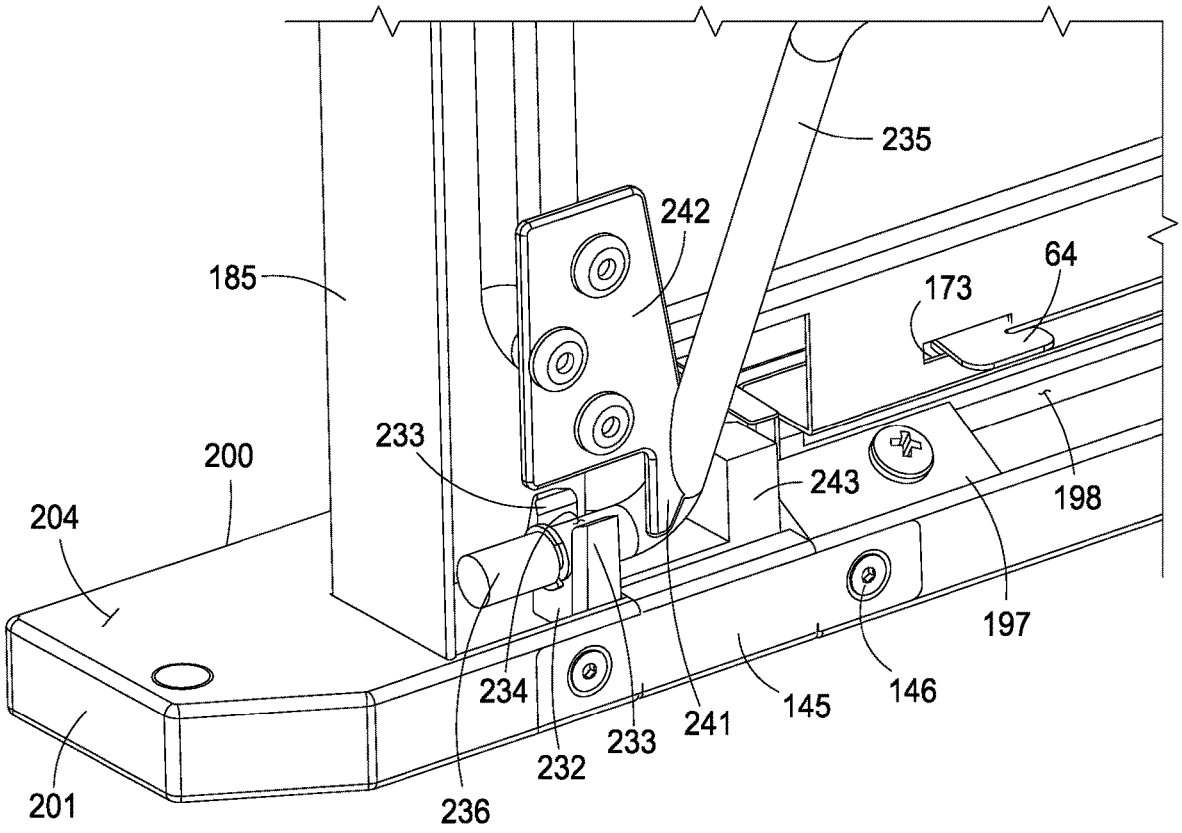
FIG. 20 is an enlarged, perspective view of the end portion of a pivoting leg and the leg end saddle.
Figure 21:
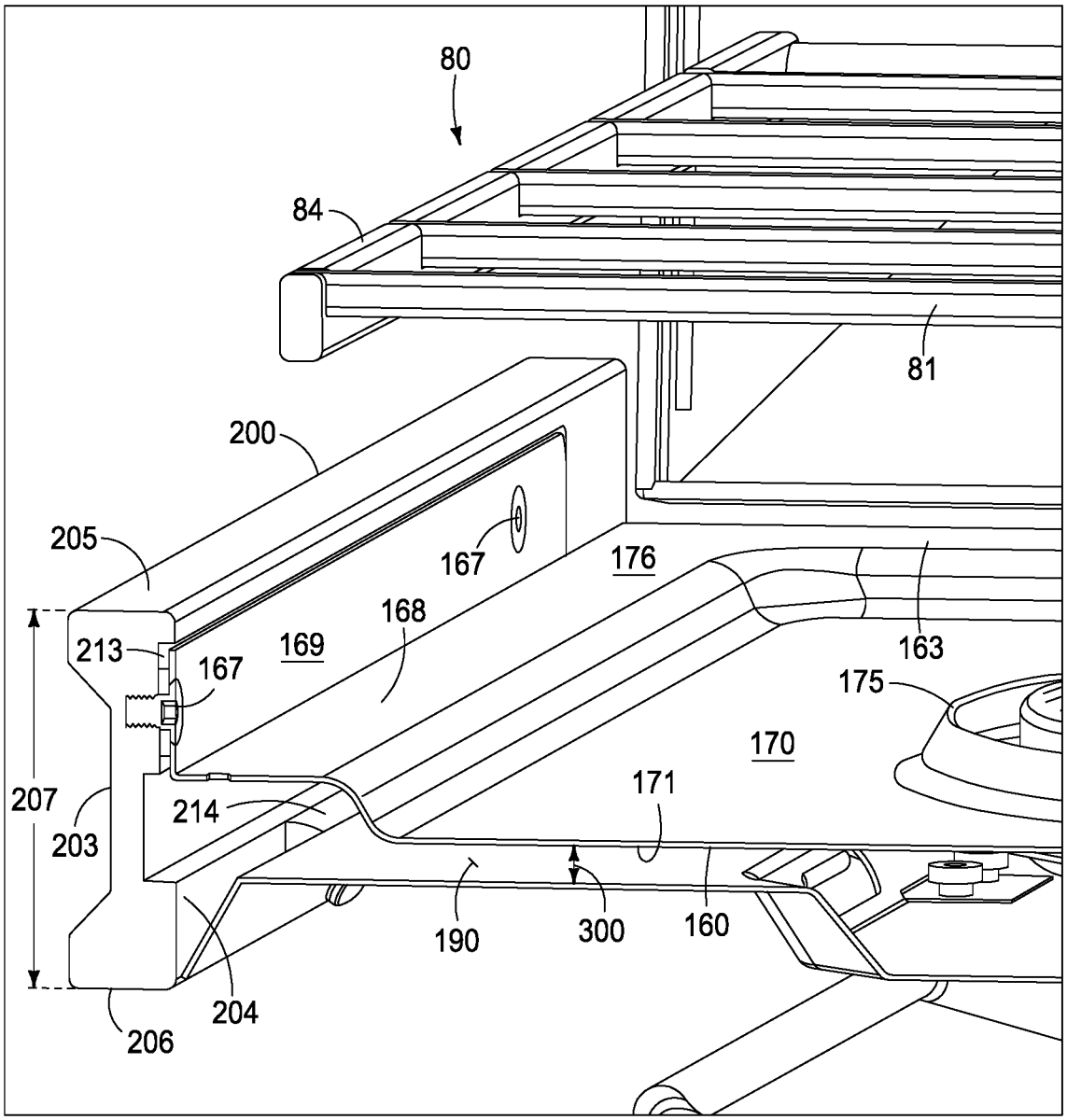
FIG. 21 is an enlarged, partial cutaway view of the collapsible camp stove, showing the space between the bottom interior of the water tray and the top interior of the bottom panel, and the mounting of the water tray and bottom panel to the first end cap.
Figure 22:
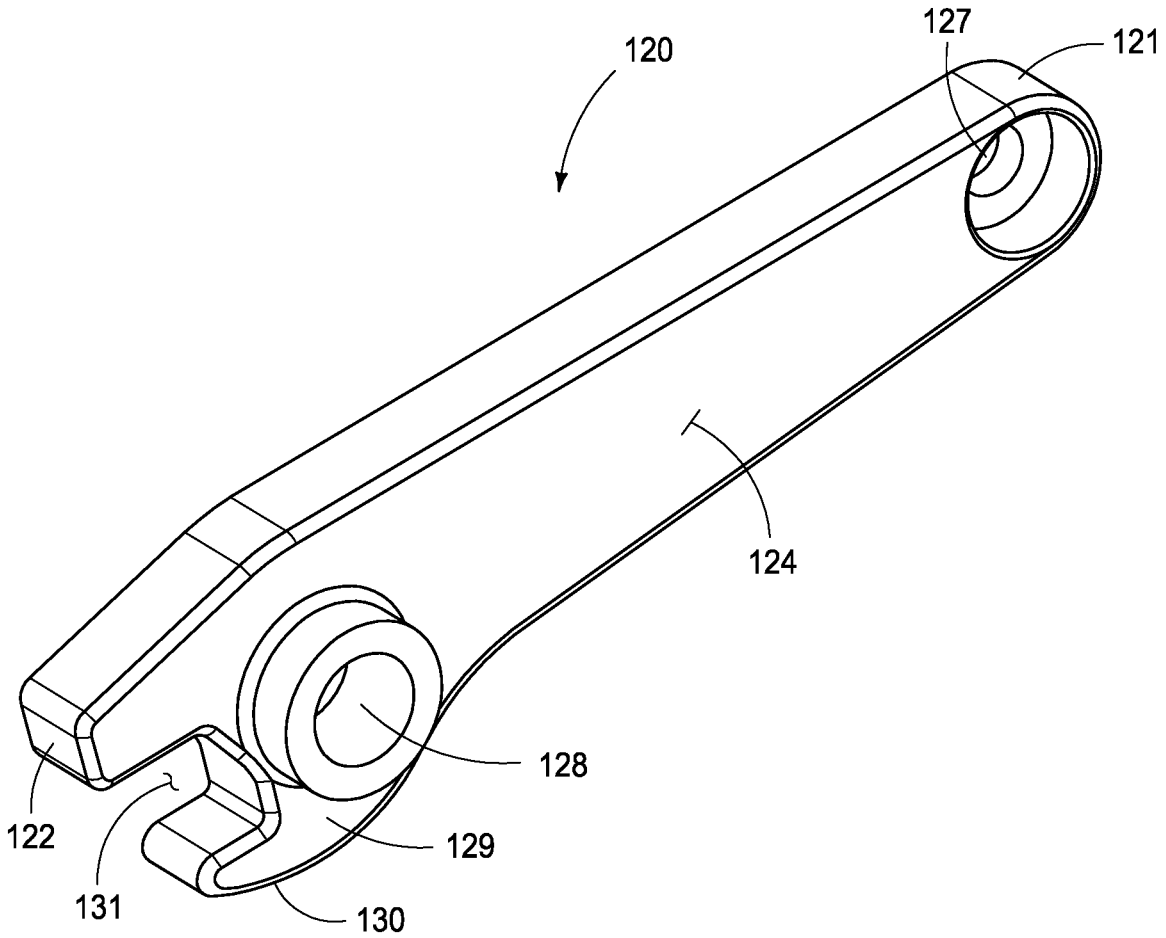
FIG. 22 is an enlarged perspective view of the laterally outer surface of the second pivot arm showing the details thereof.
Figure 23:
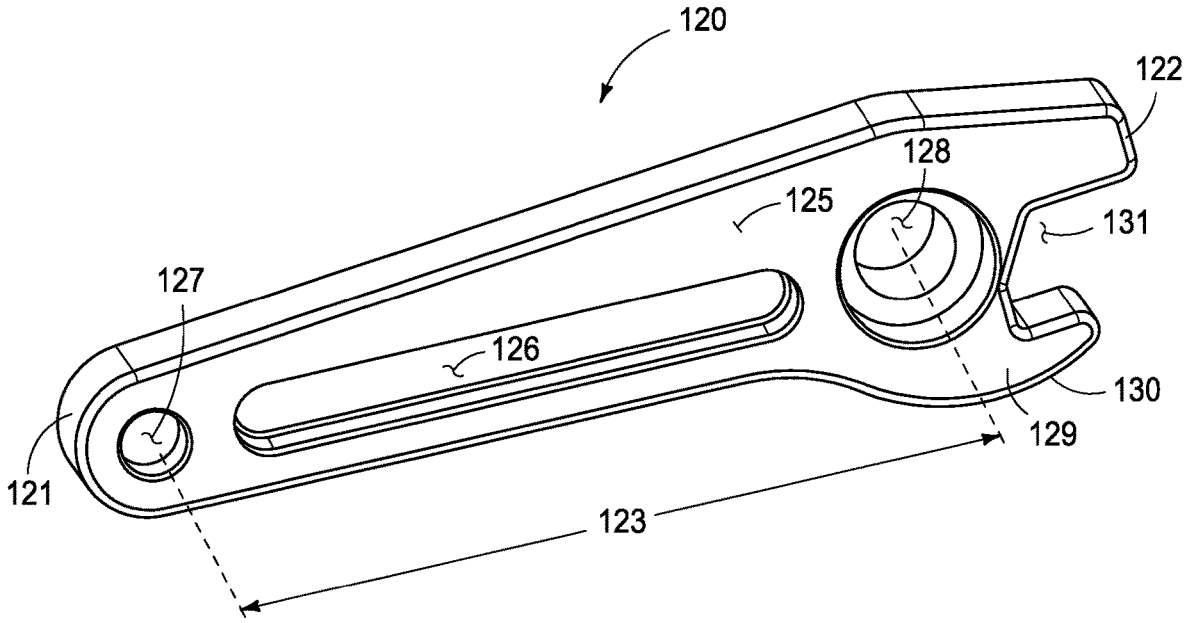
FIG. 23 is an enlarged perspective view of the laterally inner surface of the second pivot arm showing the details thereof.
Figure 24:
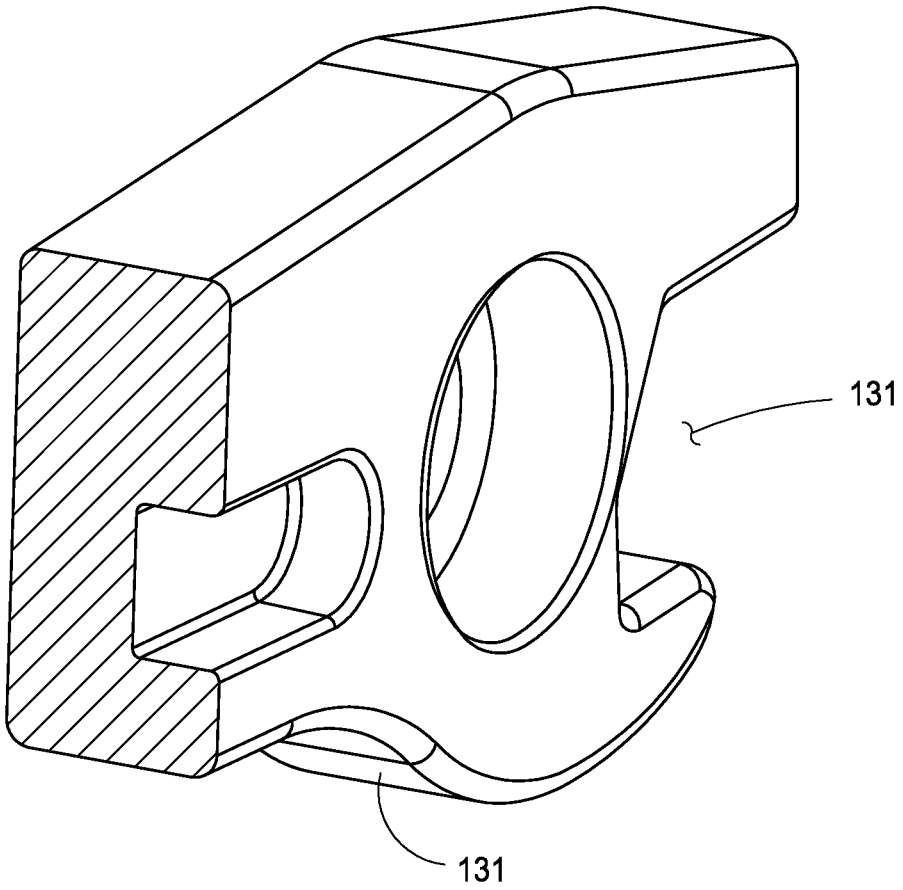
FIG. 24 is a cross section view of the second pivot arm.

Two pivoting legs 235 (FIGS. 19, 20), each having a generally U-shaped configuration, and each having two opposing spaced apart end portions 236 and a medial portion 237 that is offset from the opposing end portions 236, each end portion 236 is releasably, pivotally carried within the leg end saddles/bosses 215, 232 of the second end cap 200 and the first end cap 220, and in the preferred embodiment, each pivoting leg 235 is positionally maintained relative to the bottom panel 184 and the chassis 70 in the desired orientation (stored/extended) by a leg biasing bracket 242 having a leg biasing boss 241 that frictionally engages with the pivoting leg 235 proximate to the end portion 236 to positionally maintain the pivoting leg 235 in an over center position that is angularly outward of vertical relative to the bottom panel 184. Although not shown in FIG. 20, it is expressly contemplated the leg biasing bracket 242 may also be integrally incorporated into the leg end saddles/bosses 215, 232, and not be separate element. The over center position prevents accidental inward/folding/collapsing of the pivoting legs 235 when weight (downward force) It is exerted on the collapsible camp stove 25. The laterally outward (over center) position instead, allows downward force to "drive" the pivoting legs 235 into engagement with the leg biasing boss 243. A leg securing bracket 241 may be carried in the bottom panel 184 leg storage recess 192 to retain the pivoting leg 235 in the storage position.

Figure 16:
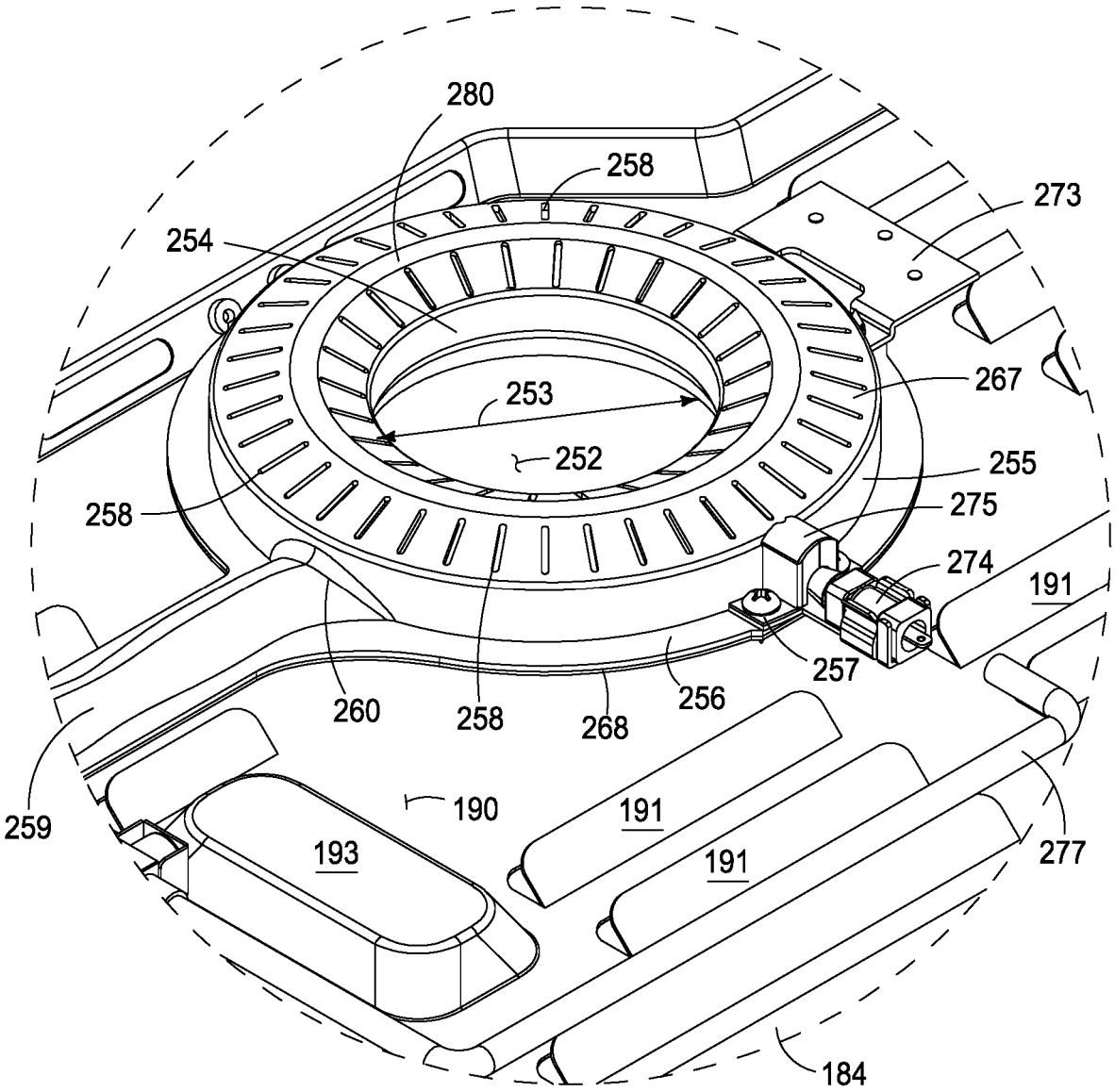
FIG. 16 is an enlarged top perspective view of the burner.
Figure 17:
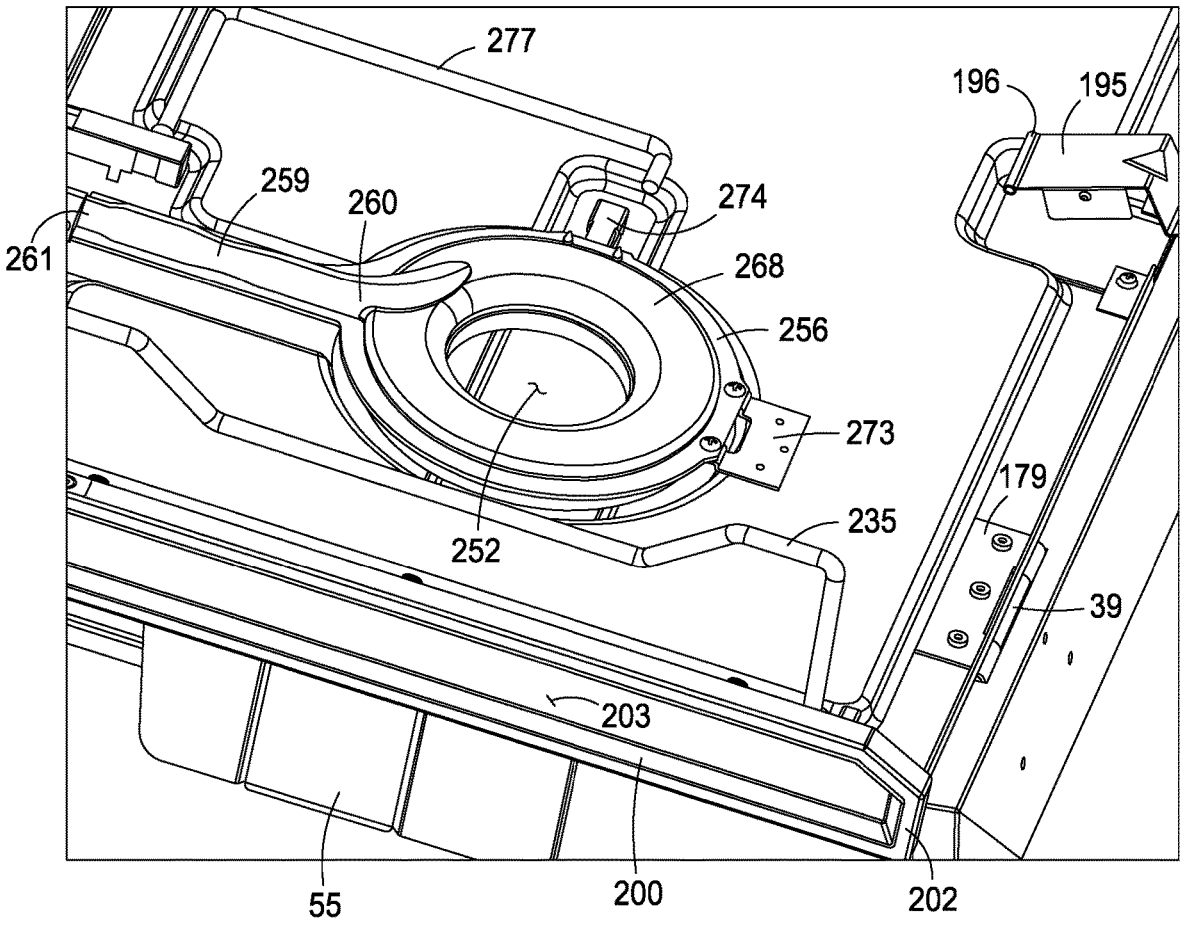
FIG. 17 is a perspective rear, bottom and the second side view of the collapsible camp stove, less the bottom panel, showing the underside of the burner.
Figure 18:
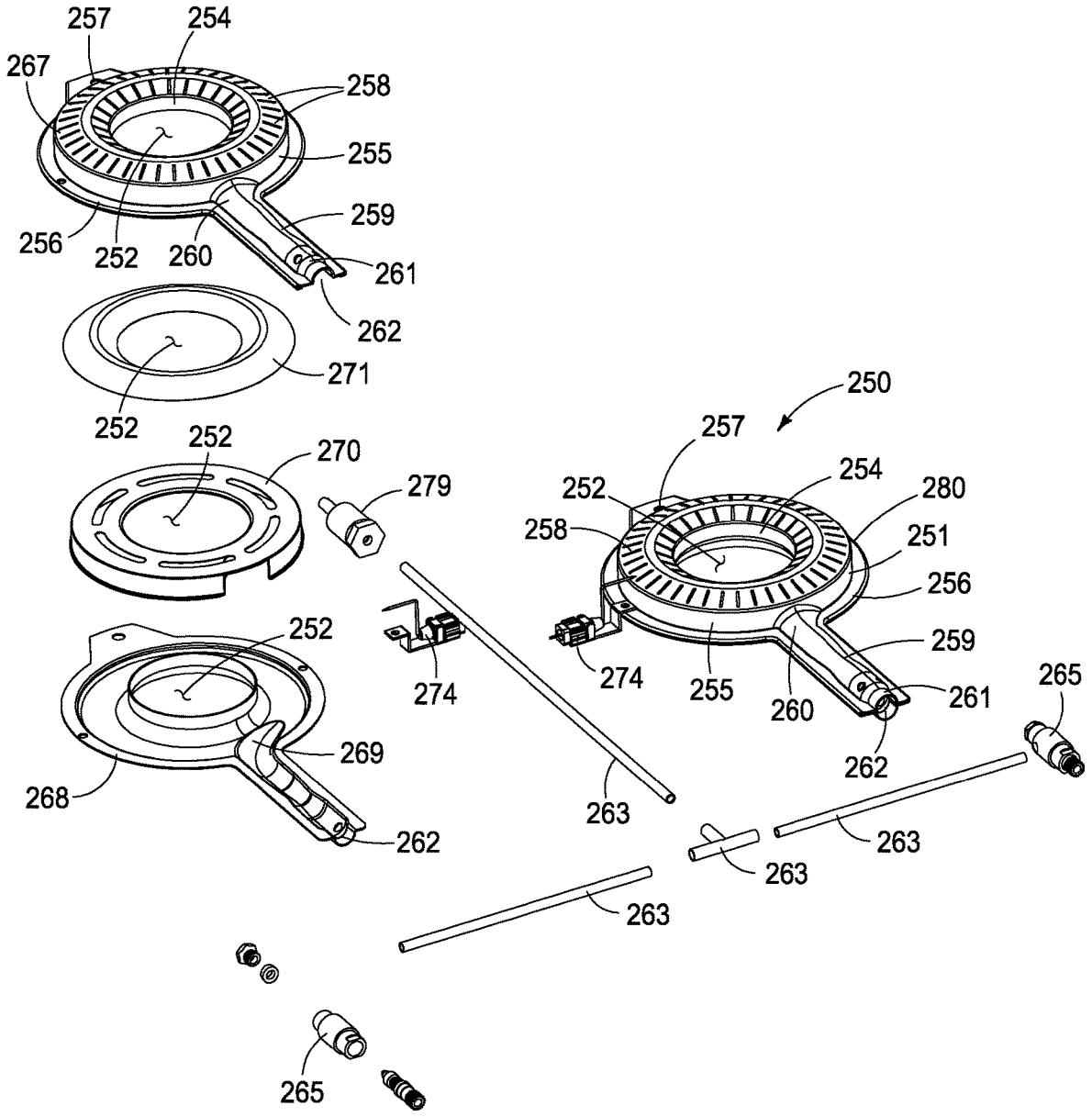
FIG. 18 is a perspective exploded view of the burner, showing the components thereof.

Burners 250 (FIGS. 14-18) are carried by the chassis 70 adjacent above the bottom panel 184, and adjacent below the water tray 160, and the burners 250 are each aligned with burner cutout 174 defined in the water tray 160. Burner 250 has an annular burner ring 251 and defines a medial hole 252 with an inner circumferential edge 254, and has a fuel tube 259 that extends radially outwardly from an outer circumferential edge 255. The fuel tube 259 has a first end portion 260 adjacent to the burner ring 251, and a second end portion 261 spaced apart from the burner ring 251. A medial channel 262 extends therebetween for passage of gaseous fuel therethrough. A valve body 265 is carried at the second end portion 261, the valve body 265 has an operator a control knob 266 that is positioned on the front panel 162 for user access. As shown in FIG. 18, burner 250 further has a burner body 280 that is comprised of a burner body top portion 267, a burner body bottom portion 268, a fuel atomizer ring 270, a fuel diffuser ring 271. A Venturi vane 269 within the fuel tube 259 alters air pressure and promotes fuel/air mixing. The fuel tube 259, the atomizer ring 270 and diffuser ring 271 are positioned medially between the top portion 267 and the bottom portion 268, and a plurality of spacedly arrayed flame ports 258 are defined in the top portion 267 for gaseous fuel to pass outwardly there-from for combustion. The atomizer ring 270 mixes and slows down the fuel/air flow rate to create even stack (or back pressure) pressure at each flame port 258 around the burner 250. The diameter 253 of the medial hole 252 of the burner 250 and exterior circumference 255 is directly related to the total sq. mm opening area of the flame ports 258. This configuration allows the instant burner 250 to generate in excess of 11K BTU, however the burner 250 may be "tuned" to generate less heat to comply with rules and regulations. A radially extending exterior flange 256 extends circumferentially about the burner 250 and mounting holes 257 are defined in the exterior flange 256 to carry fasteners for securing the burner body 280 to the interior top surface 190 of the bottom panel 184 proximate the front edge 185, and proximate the rear edge 186 with burner brackets 272, 273 so that the burner 250 is secured to the chassis 70 at only two spaced apart locations to float relative to the chassis 70 to accommodate thermal expansion. A Piezo ignitor 274 (FIG. 16), operatively communicates with the igniter button 278 on the front panel 162, and is carried in an ignitor hood 275 adjacent the outer circumferential edge 255 of the burner 250. Plural fuel exit holes (not shown) are defined in the burner body 280 adjacent to the ignitor hood 275 to promote collection of gaseous fuel there from for ease of ignition. A fuel supply line 263 communicates between the fuel port 279 carried under the fuel port hood 195, and the valve body 265 to supply the fuel to the burner 250. The fuel supply line 263 is positionally secured to the interior top surface 190 of the bottom panel 184 by a fuel line securing bracket 264.

The length dimension 43 of the riser leg 41 of the cover/rear pot support hinge first portion 38, relative to the length dimension 103 of the first and second pivot arms 100, 130 maintains the pot support 140 in an orientation that is continuously parallel with the top surface 170 of the water tray 160.

The thickness dimension of the collapsible camp stove, when in a collapsed transport configuration, from the top exterior surface of the cover 30, to the bottom exterior surface 189 of the bottom panel 184 is less than 50 mm, and more preferably is less than 45 mm, and even more preferably is less than 40 mm, and still more preferably is less than 37 mm, and even still more preferably is approximately 35 mm.

The fuel reservoir 304 preferably contains a volume of flammable propane gas. However, the instant collapsible camp stove 25 is also capable of using other flammable gases, such as, but not limited to butane and/or Iso-Butane.

Operation

Having described the structure of our collapsible camp stove, its operation is briefly described here.

The collapsible camp stove 25 is positioned on a secure supporting surface (not shown) such as a table, or even the ground surface. The collapsible camp stove 25 is pivoted upwardly at its front portion 71 on to its rear portion 72 so that the pivoting legs 235 are assessable by the user (not shown). Each pivoting leg 235 is disengaged from the leg securing bracket 241 and is pivoted downwardly away from the exterior bottom surface 189 of the bottom panel so that each pivoting leg 235 pivots within the leg end saddles/bosses 232, and against the leg biasing brackets 242. Each pivoting leg 235 is pivoted downwardly and outwardly to a position laterally outward of vertical relative to the chassis 70. The leg biasing bracket 242 maintains the pivoting leg 235 in the over center position, laterally outward a vertical relative to the chassis 70, and such over center position provides a safety measure to prevent unintentional "collapsing/retraction" of the pivoting leg 235 when weight/objects are placed on the pot support 80 when the camp stove 25 is in use. Although not shown in FIG. 20, it is expressly contemplated that the leg biasing bracket 242 may also be integrally incorporated into the leg end saddle/boss 232 and provide the same biasing to the leg 235.

After the pivoting legs 235 are fully deployed, the collapsible camp stove 25 may be pivoted forwardly so that the collapsible camp stove 25 rests upon the deployed pivoting legs 235 and the chassis 70 is positioned spacedly above the supporting surface (not shown).

The fuel port hood 195 is pivoted downwardly about the hinge 196 relative to the bottom panel 184. The hood 195 can only be pivoted downwardly when the bottom panel 184 is spaced apart from the supporting surface-such as with deployment of the pivoting legs 235. Opening of the hood 195 provides access to the fuel input port 194. Fuel reservoir 304 is operably interconnected with the fuel input port 194 with known connections, so that gaseous fuel may flow from the fuel reservoir 304 to, and into the fuel input port 194, and thereafter to the valve bodies 265 and burners 250 as desired by the user.

The user firmly grips the front edge portion 34 of the cover 30 and simultaneously raises and pushes the cover 30 rearwardly so that the cover 30 pivots on the cover hinge/rear pot support first portion 38. Pivotal movement of the cover 30 simultaneously causes the pot support 80 to raise upwardly and move rearwardly (in parallelogram fashion) on the first pivot arm 100 and on the second pivot arm 120 and on the cover/rear pot support hinge second portion 179. The movement of the pot support 80 is continuously parallel to the top exterior surface 170 of the water tray 160. As the pot support 80 rotates upwardly and rearwardly, the second pivot arm 120 arcuate camming surface 130 frictionally rotates along the spring biased lock boss 147 of the pot support lock carried by the second end 200. The arcuate camming surface 130 causes the spring biased lock boss 147 to overcome the biasing spring 144 and move downwardly relative to the second end 200, until the lock recess 131 defined in the second end portion 122 of the second pivot arm 120 is aligned with the spring biased lock boss 147, at which point the lock boss 147, responsive to the spring biasing, moves upwardly and engages within the lock recess 131 which positionally secures both the pot support 80, and the cover 30 relative to the chassis 70, and maintains a predetermined distance between the bottom 86 of the pot support 80, and the burner 250 so that complete and efficient combustion of the gaseous fuel may occur therebetween. The collapsible camp stove 25 is then ready for use.

When the collapsible camp stove 25 is to be collapsed, the pot support lock 140 is actuated by the user, with the user pressing downwardly on the laterally exterior facing surface 145 that defines the finger grip. The downward pressure on the laterally exterior facing surface 145, and finger grip, overcome the spring biasing provided by the spring 144 and causes the spring biased lock boss 147 to disengage from the lock recess 131. Once the lock boss 147 has been disengaged from the lock recess 131, the user may grasp the front edge portion 34 of the cover 30 and draw the cover 30 forwardly and downwardly toward the chassis. The pivoting closing movement of the cover 30 responsively causes the pot support 82 pivot forwardly and into a retracted position immediately adjacent to the top surface 170 of the water tray 160. Thereafter, the fuel reservoir 304 is detached from the fuel input port 194 and the fuel port hood 195 is pivoted about the hinge 196 to the closed position. The pivoting legs 235 are thereafter pivoted laterally inwardly overcoming the leg biasing brackets 242 and the pivoting legs 235 are secured immediately adjacent the bottom panel 184 within the leg storage recesses 192 defined therein, and the pivoting legs 235 are engaged in the leg securing brackets 241. Thereafter, the collapsible camp stove 25 may be moved/transported as desired by the user in its dimensionally reduced size.

A principle object of the present invention is to provide a collapsible camp stove comprising: a cover assembly; a base assembly having a fuel burner and a pot support; and the pot support and the base assembly are pivotally interconnected to one another in a parallelogram structure wherein pivotal opening movement of the cover assembly relative to the base assembly causes the pot support to raise upwardly away from a top surface of the base assembly while the pot support remains parallel to the top surface of the base assembly.

A collapsible camp stove for controlled combustion of gaseous fuel comprising: a chassis 70 having a water tray 160, a bottom panel 184, a first end cap 220, a second end cap 200, a pot support 80; and a fuel burner 250; the water tray 160 is heat reflective and generally rectilinear in peripheral configuration, and has a top exterior surface 170, an opposing bottom interior surface 171, a front portion 161, a rear portion 163, a first lateral side portion 165 having a first side flange 166, a second lateral side portion 168 having a second side flange 169, and a front panel 162 that defines cutouts 164 for an igniter button 278 and a control knob 266, and pivot leg cutouts 172, wind baffle locking slots 173, and burner cut-outs 174 are defined in the top exterior surface 170, and a cover/rear pot support hinge second portion 179 is structurally carried on the top exterior surface 170 adjacent to the rear portion 163 for pivotal interconnection with a cover/rear pot support hinge first portion 38 carried by a cover 30; and the pot support 80 has a front portion 81, a rear portion 82, a first lateral side portion 83, a second lateral side portion 84, a bottom 86, and a top 85, and the pot support 80 is pivotally movable relative to the water tray 160 on a first pivot arm 100, and a second pivot arm 120 that are pivotally interconnected to the first and second lateral sides 83, 84 proximate the front 81, and on rear pot support hinge portions 38 carried by the cover 30 proximate the rear portion 82 so that the pot support 80 moves in, and is maintained in, a continuously parallel orientation, and in parallelogram configuration relative to the water tray 160 responsive to the cover 30 being pivotally opened and closed relative to the chassis 70; and the first end cap 220 and the second end cap 200 form first and second side portions of the chassis 70 and each has a recess 229, 209 defined in a laterally inner side portion 223, 203 to facilitate flush mounting the side flanges 166, 169 of the water tray 160 to the end caps 220, 200, and angled fillets 230, 214 are defined in the laterally inner side portion 223 spacedly adjacent a bottom 226 to facilitate non-flush mounting with bottom panel 184 to prevent heat conduction from the bottom panel 184 to the end caps 220, 200, and two spaced apart leg end saddles/bosses 232 are defined by each end cap 220, 200, adjacent the bottom 226, 206, to pivotally carry legs 235; and the bottom panel 184 has a front edge 185, a rear edge 186, a first side 187, a second side 188, an exterior bottom surface 189, an interior top surface 190, and defines a plurality of spacedly arrayed air vents 191, and an angled side flange 197 is carried at the first side 187, and at the second side 188, and each side flange 197 is configured to engage with the adjacent end cap 200, 220 in a non-flush mounting orientation so that a gap 198 is maintained between each side flange 197 and the adjacent end cap 200, 220 to minimize heat conduction therebetween, and a fixed distance 300 is maintained between the top interior surface 190 of the bottom panel 184, and the bottom interior surface 171 of the water tray 160 so that air-flow is maintained therebetween; and the burner 250 is carried adjacent above the bottom panel 184, and adjacent below the water tray 160, and aligned with burner cutout 174, and the burner 250 is annular in configuration and has a fuel tube 259 that extends radially outwardly from an outer circumferential edge 255, and a valve body 265 is carried at a second end portion 261 of the fuel tube 259 spaced apart from the outer circumferential edge 255, and has an operator control knob 266 positioned on the front panel 162 for user access, and a fuel supply line 263 communicates between a fuel port 279 proximate the rear edge 186, and the valve body 265 to supply fuel to the burner 250; and a cover is pivotally interconnected to the chassis 70 and has an exterior top surface 32 and an interior bottom surface 33 and structurally carries a cover/rear pot support hinge first portion 38 on the interior bottom surface 33 adjacent a rear bottom edge 35B to pivotally interconnect with a cover/rear pot support hinge second portion 179 carried by the chassis 70, and the cover/rear pot support hinge first portion 38 has a riser leg 41 with a pot support saddle 42 that is configured to rotatably engage with the pot support 80 to move the pot support 80 in an arc 44 relative to the water tray 160 and at a predetermined fixed distance 43 from the water tray 160; and a length dimension 43 of the riser leg 41 of the cover/rear pot support hinge first portion 38, relative to a length dimension 103 of the first and second pivot arms 100, 130 maintains the top 85 and bottom 86 of the pot support 80 in an orientation that is continuously parallel with the top surface 170 of the water tray 160; and pivotal opening and closing of the cover 30 relative to the chassis 70 moves the pot support 80 between a first position parallel to and immediately adjacent the water tray 160 and a second position parallel to and spaced apart above from the water tray 160.

A wind baffle 55 is pivotally interconnected to a wind baffle hinge first portion 45 carried at the first lateral edge bottom edge 36B and at the second lateral edge bottom edge 37B of the cover 30, and each wind baffle 55 has a generally "L" configuration with a laterally exterior facing surface 57, a laterally interior facing surface 58, a hinge edge 59, a bottom edge 62 having a position locking tab 64 at an end portion opposite the hinge edge 59, and the hinge edge 59 structurally carries a wind baffle hinge second portion 60 that is configured to axially slide along a hinge pin 61 carried by the wind baffle hinge first portion 45 so that each wind baffle 55 is both rotatably movable about the hinge pin 61 and also axially movable along the hinge pin 61 between a first folded in/retracted position and a second extended use position, and the laterally interior facing surface 58 of each wind baffle 55 has at least one pleat thereon that frictionally contacts the interior bottom surface 33 of the cover 30 when the wind baffle 55 is in the first folded/retracted position to prevent adhesion to the cover 30 interior bottom surface 3.

A further object of the present invention is to provide a collapsible camp stove wherein a magnet 46, which may be, but is not limited to a neodymium magnet is carried by the cover 30 at an edge portion 34, 36, 37 to be magnetically attracted to a ferrous body 47 carried by the chassis 70 to magnetically positionally secure the cover 30 in a closed orientation relative to the chassis 70.

A further object of the present invention is to provide a collapsible camp stove wherein the pot support lock 140 is carried in a notch 218 defined in the second end cap 200 laterally outer side portion 203 proximate the front end portion 201, and the pot support lock 140 has a laterally exterior facing surface 141 that defines a finger grip, an opposing interior facing surface 142 that carries a locking boss 147 that releasably engages within a locking recess 131 defined in the second pivot arm 120 second end portion 122, and the pot support lock 140 is biased by a spring 144, relative to the second end cap 200 into a position for secure releasable engagement with the locking recess 131 defined in the second pivot arm 130, and an arcuate camming surface 130 extending partially about the second end portion 122 of the second pivot arm 120 facilitates frictional sliding engagement of the second end portion 122 over the locking boss 147 which forces the locking boss 147 downwardly and overcoming the spring biasing as the second pivot arm 120 rotates about pivot axle 89, and a lock cap 145, that is secured with fasteners 146 positionally secures the spring 144 and the pot support lock 140 in the notch 218 defined in the second end cap 220 and maintains the positional biasing of the pot support lock 140 toward the top portion 206 of the second end cap 200 and into engagement with the locking recess 131.

A further object of the present invention is to provide a collapsible camp stove wherein the fuel port hood 195 is pivotally carried by the bottom panel 184 on a hinge 196 adjacent to the fuel input port 194 to pivot the fuel port hood 195 downwardly relative to the bottom panel 184; and to prevent access to the fuel input port 194 without prior deployment of the pivoting legs 135 relative to the chassis 70.

A further object of the present invention is to provide a collapsible camp stove wherein the thickness dimension of the collapsible camp stove, when in a collapsed transport configuration, from the top exterior surface of the cover 30, to the bottom exterior surface 189 of the bottom panel 184 is less than 50 mm.

A further object of the present invention is to provide a collapsible camp stove wherein the thickness dimension of the collapsible camp stove, when in a collapsed transport configuration, from the top exterior surface of the cover 30, to the bottom exterior surface 189 of the bottom panel 184 is less than 45 mm.

A further object of the present invention is to provide a collapsible camp stove wherein the thickness dimension of the collapsible camp stove, when in a collapsed transport configuration, from the top exterior surface of the cover 30, to the bottom exterior surface 189 of the bottom panel 184 is less than 50 mm, and more preferably is less than 45 mm, and even more preferably is less than 40 mm, and still more preferably is less than 37 mm, and even still more preferably is approximately 35 mm.

A further object of the present invention is to provide a collapsible camp stove wherein the cover/rear pot support hinge first portion 38 is structurally carried on the interior bottom surface 33 of the cover 30 adjacent to the rear bottom edge 35B to pivotally interconnect with a cover/rear pot support hinge second portion 179 carried by the chassis 70, and each cover/rear pot support hinge first portion 38 has a pin barrel 39 to axially receive a hinge pin 40 therein, and has a riser leg 41 extending distally from the pin barrel 39, the riser leg 41 structurally carrying a generally "U" shaped pot support saddle 42 at an edge portion opposite the pin barrel 39, and the pot support saddle 42 is configured to engage with, and securely rotatably carry, a rear-most rail 88 of the pot support 80, and the pot support saddle 42 moves in an arc 44 relative to the pin barrel 39 and at a predetermined fixed distance 43 from the pin barrel 39.

A still further object of the present invention is to provide a collapsible camp stove wherein the pot support 80 bottom 86 is parallel to, and immediately adjacent to, the top surface 170 of the water tray 160 when the cover 30 is in a closed orientation relative to the chassis 70, and the pot support 80 bottom 86 is spaced apart from the top surface 170 of the water tray 160 a distance of 41 mm, and parallel to the top surface 170, when the cover 30 is in an open orientation relative to the chassis 70.

A still further object of the present invention is to provide a collapsible camp stove wherein the first pivot arm 100 is formed of a heat resistant material, is elongate and has a first end portion 101, a non-circular second end portion 102, a laterally exterior facing surface 104, a laterally interior facing surface 105, an axle hole 107 defined in the first end portion 101, an axle hole 108 defined in the second end portion 102 with a length dimension 103 therebetween, and the second end portion 102 is radially enlarged to define an arcuate camming surface 112, a flat support surface 110 and a corner portion 111, and the first end portion 101 of the first pivot arm is pivotally interconnected to the first lateral side portion 83 of the pot support 80 spacedly adjacent the front portion 81 on a pivot axle 89 that extends through the axle hole 107 and the noncircular second end portion 102 is pivotally interconnected to a laterally inner side portion 224 of the first end cap 220 on a pivot axle 89 that extends through the axle hole 108 defined in the second end portion 102 adjacent above a pivot arm boss 231 carried by the first end cap 220 so that the flat support service 110 and corner portion 111 frictionally and/or compressively rest upon the pivot arm boss 231 when the cover 30 is in an open orientation relative to the chassis 70.

A still further object of the present invention is to provide a collapsible camp stove wherein the second pivot arm 120 is formed of a heat resistant material, is elongate and has a first end portion 121, a non-circular second end portion 122, a laterally exterior facing surface 124, a laterally interior facing surface 125, an axle hole 127 defined in the first end portion 121, and an axle hole 128 defined in the second end portion 122 with a length dimension 123 therebetween, and the second end portion 122 is radially enlarged and defines a lock recess 131 and an arcuate camming surface 130, and the first end portion 121 is pivotally interconnected with the second lateral side portion 84 of the pot support 80 spacedly adjacent the front portion 81 on a pivot axle 89 that extends through the axle hole 127 and the second end portion 122 is pivotally interconnected to laterally inner side portion 204 of the second end cap 200 on a pivot axle 89 that extends through the axle hole 128 in the second end portion 122, adjacent above a spring biased pot support lock 140 carried by the second end cap 200.

A still further object of the present invention is to provide a collapsible camp stove wherein the first end cap 220 forms a first side portion to the chassis 70 and has a front end portion 221, a rear end portion 222, a laterally outer side portion 223, a laterally inner side portion 224, a top 225 and a bottom 226 with a thickness dimension 227 between the top 225 and the bottom 226, and a recess 229 is defined in the laterally inner side portion 223 spacedly adjacent to the top 225 to facilitate flush mounting with the first side flange 166 of the water tray 160, and angled fillets 230 are defined in the laterally inner side portion 223 spacedly adjacent the bottom 226 to facilitate non-flush mounting with the bottom panel 184 to prevent heat conduction from the bottom panel 184 to the first end cap 220, and a cover engaging boss 228 is defined on the laterally inner side portion 224 adjacent to the front end portion 221 to operatively cooperate with the second end portion 102 of the first pivot arm 100, and two spaced apart leg end saddles/bosses 232 are defined on the laterally inner side portion 224, adjacent to the bottom 266 to pivotally carry a pivotally movable leg 235, each leg end saddle/boss 232 may have two spaced apart saddle engagement arms 233 which define a saddle opening 234, or a hole (not shown) to carry and end of the pivoting leg 235; and the second end cap 200 forms a second side portion to the chassis 70 and the second end cap 200 carries a pot support lock 140, the second end cap 200 has a front end portion 201, a rear end portion 202, a laterally outer side portion 203, a laterally inner side portion 204, a top 205 and a bottom 206 with a thickness dimension 207 between the top 205 and the bottom 206, and a recess 213 is defined in the laterally inner side portion 203 spacedly adjacent to the top 205 to facilitate flush mounting with the second side flange 169 of the water tray 160, and angled fillets 214 are defined in the laterally inner side portion 203 spacedly adjacent to the bottom 206 to facilitate non-flush mounting with the bottom panel 184 to prevent heat conduction from the bottom panel 184 to the second end cap 200, a cover engaging boss 212 is defined on the laterally inner side portion 204 adjacent to the front end portion 201, and two spaced apart leg end saddles/bosses 215 are defined by the second end cap 200 on the laterally inner side portion 204, adjacent to the bottom portion 206 to releasably and pivotally carry pivotally movable legs 235, each leg end saddle/boss 215 having two spaced apart saddle engagement arms 216 which define a saddle opening 217, or a hole (not shown) to carry an end portion of the pivoting leg 235.

A still further object of the present invention is to provide a collapsible camp stove wherein the collapsible camp stove has plural burners 250, and each burner 250 has a burner body 280 that is comprised of a burner body top portion 267, a burner body bottom portion 268, a fuel atomizer ring 270, a fuel diffuser ring 271, and a Venturi vane 269 that affects air pressure and promotes fuel/air mixing is carried within the fuel tube 259, the atomizer ring 270 and diffuser ring 271 are carried between the top portion 267 and the bottom portion 268, and a plurality of spacedly arrayed flame ports 258 are defined in the top portion 267 for gaseous fuel to pass outwardly there-from for combustion, a radially extending exterior flange 256 extends circumferentially about the burner body 280 and mounting holes 257 are defined in the exterior flange 256 to carry fasteners for securing the burner body 280 to the interior top surface 190 of the bottom panel 184 proximate the front edge 185, and proximate the rear edge 186 with burner brackets 272, 273 so that the burner body 280 is secured to the chassis 70 at two spaced apart locations to float relative to the chassis 70 to accommodate thermal expansion, a Piezo ignitor 274, operatively communicates with the igniter button 278, and is carried in a ignitor hood 275 adjacent the outer circumferential edge 255 of the burner body 280, and plural fuel exit holes 276 are defined in the burner body 280 adjacent to the ignitor hood 275 to promote collection of the gaseous fuel within the hood 275 and ignition of the gaseous fuel.

A still further object of the present invention is to provide a collapsible camp stove wherein the water tray 180 is metallic, heat reflective, generally rectilinear in peripheral configuration and has a generally planar top surface 170 that defines a raised peripheral edge 176, an opposing bottom interior surface 171, a front portion 161, a rear portion 163, a first lateral side portion 165, a second lateral side portion 168, and a front panel 162 that extends generally perpendicularly downwardly from the front portion 161, and the front panel defines plural spacedly arrayed cutouts 164 for an igniter button 278 and for a control knob 266, a first side flange 166 at the first lateral side portion 165 extends generally perpendicularly upwardly relative to the top surface 170, and a second side flange 169 at the second lateral side portion 168 extends generally perpendicularly upwardly relative to the top surface 170, and pivot leg cutouts 172, and wind baffle locking slots 173, are defined in the top surface 170 spacedly adjacent to the first lateral side 165 and spacedly adjacent to the second lateral side 168, and spaced apart from the front panel 162, and two spaced apart burner cutouts 174 are defined in the top surface 170, each burner cutout 174 has a peripheral edge 175 that is angled upwardly opposite the bottom surface 171, and the cover/rear pot support hinge second portion 179 is structurally carried on the top surface 170 adjacent to the rear portion 163 for pivotal interconnection with the cover/rear pot support hinge first portions 38 carried by the cover 30.

An even still further object of the present invention is to provide a collapsible camp stove for controlled combustion of gaseous fuel comprising: a chassis 70; a cover pivotally interconnected to the chassis 70 and; a gaseous fuel burner 250 carried by the chassis 70; and the cover 30 is generally rectilinear in peripheral configuration and has plural spacedly arrayed integral polyhedral bends 31 to add rigidity, the cover 30 has an exterior top surface 32, an interior bottom surface 33, a front edge portion 34, a rear edge portion 35, a first lateral edge portion 36, and a second lateral edge portion 37, and each of the edge portions 34, 35, 36, 37 extend, in the same direction, generally perpendicularly away from the exterior top surface 32 and toward the interior bottom surface 33, and each of the edge portions 34, 35, 36, 37 has an upper edge portion 34A, 35A, 36A, 37A adjacent the exterior top surface 32, and each has a lower edge portion 341, 35B, 36B, 37B spaced apart from the exterior top surface 32; a cover/rear pot support hinge first portion 38 is structurally carried on the interior bottom surface 33 of the cover 30 adjacent to the rear bottom edge 35B to pivotally interconnect with a cover/rear pot support hinge second portion 179 carried by the chassis 70, each cover/rear pot support hinge first portion 38 has a pin barrel 39 to axially receive a hinge pin 40 therein, and has a riser leg 41 extending distally from the pin barrel 39, the riser leg 41 structurally carrying a generally "U" shaped pot support saddle 42 at an edge portion opposite the pin barrel 39, and the pot support saddle 42 is configured to engage with, and securely rotatably carry, a rear-most rail 88 of pot support 80, and the pot support saddle 42 moves in an arc 44 relative to the pin barrel 39 and at a predetermined fixed distance 43 from the pin barrel 39; a wind baffle 55 is pivotally interconnected to a wind baffle hinge first portion 45 that is carried at the first lateral edge bottom edge 368 and carried at the second lateral edge bottom edge 378 of the cover 30, and each wind baffle 55 has a generally "L" configuration with a laterally exterior facing surface 57, a laterally interior facing surface 58, a hinge edge 59, a bottom edge 62 having a position locking tab 64 at an end portion opposite the hinge edge 59, an upper edge 63 that defines the "L" configuration, and the hinge edge 59 structurally carries a wind baffle hinge second portion 60 that is configured to axially slide along hinge pin 61 carried by the wind baffle hinge first portion 45 so that the wind baffle 55 is both rotatably movable about the hinge pin 61 and also axially movable along the hinge pin 61 between a first folded in/retracted position and a second extended use position, and the laterally interior facing surface 58 has at least one pleat thereon that frictionally contacts the interior bottom surface 33 of the cover 30 when the wind baffle 55 is in the first folded/retracted position to prevent sticking to the cover 30 interior bottom surface 33; the chassis 70 is comprised of a water tray 160, a bottom panel 184, a first end cap 220, a second end cap 200, a pot support 80; and the gaseous fuel burner 250, the water tray 160 is metallic, heat reflective, generally rectilinear in peripheral configuration and has a somewhat planar top surface 170 that defines a raised peripheral edge 176, an opposing bottom interior surface 171, a front portion 161, a rear portion 163, a first lateral side portion 165, a second lateral side portion 168, and a front panel 162 that extends generally perpendicularly downwardly from the front portion 161, and the front panel defines plural spacedly arrayed cutouts 164 for an igniter button 278 and a control knob 266, a first side flange 166 at the first lateral side portion 165 extends generally perpendicularly upwardly relative to the top surface 170, and a second side flange 169 at the second lateral side portion 168 extends generally perpendicularly upwardly relative to the top surface 170, and pivot leg cutouts 172, and wind baffle locking slots 173, are defined in the top surface 170 spacedly adjacent to the first lateral side 165 and to the second lateral side 168, and spaced apart from the front panel 162, and two spaced apart burner cutouts 174 are defined in the top surface 170, each burner cutout 174 has a peripheral edge 175 that is angled upwardly opposite the bottom surface 171, and the cover/rear pot support hinge second portion 179 is structurally carried on the top surface 170 adjacent to the rear portion 163 for pivotal interconnection with the cover/rear pot support hinge first portions 38 carried by the cover 30; the pot support 140 is generally planar and rectilinear and is formed of a plurality of spacedly arrayed and structurally interconnected rails 87, that are preferably formed of metal, and the pot support 140 has a front portion 81, a rear portion 82, a first lateral side portion 83, a second lateral side portion 84, a bottom 86, and the top 85 for supporting cooking vessels thereon, the pot support 140 has a rearmost rail 88 at the rear portion 82 that operatively engages with the support saddle 42 carried by the cover hinge/rear pot support first portion 38, and the pot support 140 is pivotally interconnected to the chassis 70 proximate the first end portion 81 by a first pivot arm 100, and a second pivot arm 120 so that the pot support 140 moves in a continuously parallel orientation, and in parallelogram configuration relative to the chassis 70 responsive to the cover 30 being pivotally opened and closed relative to the chassis 70; the first pivot arm 100 is formed of a heat resistant material, is elongate and has a first end portion 101, a non-circular second end portion 102, a laterally exterior facing surface 104, a laterally interior facing surface 105, an axle hole 107 defined in the first end portion 101, an axle hole 108 defined in the second end portion 102 with a length dimension 103 therebetween, and the second end portion 102 is radially enlarged to define a curved camming surface 112, a flat support surface 110 and a corner portion 111, and the first end portion 101 is pivotally interconnected with the first lateral side portion 83 of the pot support 80 spacedly adjacent the front portion 81 on a pivot axle 89 that extends through the axle hole 107 at the first end portion 101, and the noncircular second end portion 102 is pivotally interconnected to, laterally inner side portion 224 of the first end cap 220 on a pivot axle 89 that extends through the axle hole 108 defined in the second end portion 102 adjacent above a pivot arm boss 231 carried by the first end cap 220 so that the flat support service 110 and corner portion 111 frictionally and or compressively rest upon the pivot arm boss 231 when the cover 30 is in an open orientation; the second pivot arm 120 is formed of a heat resistant material, is elongate and has a first end portion 121, a non-circular second end portion 122, a laterally exterior facing surface 124, a laterally interior facing surface 125, an axle hole 127 defined in the first end portion 121, and an axle hole 128 defined in the second end portion 122 with a length dimension 123 therebetween, and the second end portion 122 is radially enlarged and defines a lock recess 131 and an arcuate camming surface 130, and the first end portion 121 is pivotally interconnected with the second lateral side portion 84 of the pot support 80 spacedly adjacent the front portion 81 on a pivot axle 89 that extends through the axle hole 127 in the first end portion 121, and the second end portion 122 is pivotally interconnected to laterally inner side portion 204 of the second end cap 200 on a pivot axle 89 that extends through the axle hole 128 in the second end portion 122, adjacent above a spring biased pot support lock 140 carried by the second end cap 200 the first end cap 220 is preferably of thermally resistant, and non-heat conductive material and forms a first side portion to the chassis 70 and has a front end portion 221, a rear end portion 222, a laterally outer side portion 223, a laterally inner side portion 224, a top 225 and a bottom 226 with a thickness dimension 227 between the top 225 and the bottom 226, and a recess 229 is defined in the laterally inner side portion 223 spacedly adjacent to the top 225 to facilitate flush mounting with the first side flange 166 of the water tray 160, and angled fillets 230 are defined in the laterally inner side portion 223 spacedly adjacent the bottom 226 to facilitate non-flush mounting with the bottom panel 184 to prevent heat conduction from the bottom panel 184 to the first end cap 220, a cover engaging boss 228 is defined on the laterally inner side portion 224 adjacent to the front end portion 221, and two spaced apart leg end saddles/bosses 232 are defined by the first end cap 220 on the laterally inner side portion 224, adjacent to the bottom 266 to releasably and pivotally carry pivotally movable legs 235, each leg end saddle/boss 232 having two spaced apart saddle engagement arms 233 which define a saddle opening 234, or a hole (not shown); the second end cap 200 is also preferably of thermally resistant, and non-heat conductive material and forms a second side portion to the chassis 70 and the second end cap 200 carries the pot support lock 140, the second end cap 200 has a front end portion 201, a rear end portion 202, a laterally outer side portion 203, a laterally inner side portion 204, a top 205 and a bottom 206 with a thickness dimension 207 between the top 205 and the bottom 206, and a recess 213 is defined in the laterally inner side portion 203 spacedly adjacent to the top 205 to facilitate flush mounting with the second side flange 169 of the water tray 160, and angled fillets 214 are defined in the laterally inner side portion 203 spacedly adjacent to the bottom 206 to facilitate non-flush mounting with the bottom panel 184 to prevent heat conduction from the bottom panel 184 to the second end cap 200, a cover engaging boss 212 is defined on the laterally inner side portion 204 adjacent to the front end portion 201, and two spaced apart leg end saddles/bosses 215 are defined by the second end cap 200 on the laterally inner side portion 204, adjacent to the bottom portion 206 to releasably and pivotally carry pivotally movable legs 235, each leg end saddle/boss 215 having two spaced apart saddle engagement arms 216 which define a saddle opening 217, or a hole (not shown); and the pot support lock 140 is movably carried in notch 218 defined in the second end cap 200 laterally outer side portion 203 proximate the front end portion 201, and the pot support lock 140 has a laterally exterior facing surface 141 that defines a finger grip, an opposing interior facing surface 142 that carries a locking boss 147 that releasably engages within the locking recess 131 defined in the second end portion 122 of the second pivot arm 120, and the pot support lock 140 is biased by a spring 144 into a position for secure releasable engagement with the locking recess 131 defined in the second pivot arm 130, and the arcuate camming surface 130 facilitates frictional sliding engagement of the second end portion 122 over the locking boss 147 which forces the locking boss 147 downwardly and overcoming the spring biasing as the second pivot arm 120 rotates, and a lock cap 145, that is secured with fasteners 146 positionally secures the spring 144 and the pot support lock 140 in the notch 218 and maintains the positional biasing of the pot support lock 140 toward the top portion 205 of the second end cap 200 and into engagement with the locking recess 131; and the bottom panel 184 is generally planar and rectilinear in peripheral configuration and has a front edge 185, a rear edge 186, a first side 187, a second side 188, an exterior bottom surface 189, an interior top surface 190, and defines a plurality of spacedly arrayed air vents 191 that are each angled upwardly toward the Interior top surface 190, a leg storage recess 192 is defined in the bottom panel 184 spacedly adjacent the first side 187 and spacedly adjacent the second side 188 for storage of the pivoting legs 235, a finger ignition recess 193 is defined in the bottom panel 184 adjacent the front edge 185 and aligned with the igniter button 278 of the front panel 162, a fuel input port 194 is defined in the rear edge 186, and a fuel port hood 195 is pivotally carried on a hinge 196 adjacent to the fuel input port 194 to pivot the fuel port hood 195 downwardly relative to the bottom panel 184, an angled side flange 197 is carried at the first side 187, and at the second side 188, and each side flange 197 is configured to engage with the adjacent end cap 200, 220 in a non-flush orientation so that a gap 198 is maintained between each side flange 197 and the adjacent end cap 200, 220 to minimize heat conduction therebetween, and a fixed distance 300 is maintained between the top interior surface 190 of the bottom panel 184, and the bottom interior surface 171 of the water tray 160 so that a space for air-flow is maintained therebetween; and two pivoting legs 235, each having a generally U-shaped configuration, and each having two opposing spaced apart end portions 236 and a medial portion 237 that is offset from the opposing end portions 236, each end portion 236 is releasably, pivotally carried within the leg end saddles/bosses 215, 232 of the second end cap 200 and the first end cap 220, and each pivoting leg 235 is positionally maintained relative to the bottom panel 184 by a leg lock 208 having a position securing flange 211 that frictionally engages with the pivoting leg 235 proximate to the end portion 236 to positionally maintain the pivoting leg 235 in an over center position that is angularly outward of vertical relative to the bottom panel 184; and two burners 250 are carried by the chassis 70 adjacent above the bottom panel 184, and adjacent below the water tray 160, and the burners 250 are each aligned with burner cutout 174 defined in the water tray 160, and each burner 250 has a burner ring 251 that is annular in configuration and defines a medial hole 252 with an inner circumferential edge 254, and has a fuel tube 259 that extends radially outwardly from an outer circumferential edge 255 of the burner ring 251, the fuel tube 259 has a first end portion 260 adjacent to the burner ring 251, and a second end portion 261 spaced apart from the burner ring 251 with a medial channel therebetween for passage of gaseous fuel therethrough, and a valve body 265 is carried at the second end portion 261, the valve body 265 has an operator a control knob 266 that is positioned on the front panel 162 for user access, each burner 250 further has a burner body 280 that is comprised of a burner body top portion 267, a burner body bottom portion 268, a fuel atomizer ring 270, a fuel diffuser ring 271, and a Venturi vane 269 that alters air pressure and promotes fuel/air mixing is carried within the fuel tube 259, the atomizer ring 270 and diffuser ring 271 are positioned medially between the top portion 267 and the bottom portion 268, and a plurality of spacedly arrayed flame ports 258 are defined in the top portion 267 for gaseous fuel to pass outwardly there-from for combustion, a radially extending exterior flange 258 extends circumferentially about the burner body 280 and mounting holes 257 are defined in the exterior flange 256 to carry fasteners for securing the burner body 280 to the interior top surface 190 of the bottom panel 184 proximate the front edge 185, and proximate the rear edge 186 with burner brackets 272, 273 so that the burner body 280 is secured to the chassis 70 at only two spaced apart locations to float relative to the chassis 70 to accommodate thermal expansion, a Piezo ignitor 274, operatively communicates with the igniter button 278 on the front panel 162, and is carried in a ignitor hood 275 adjacent the outer circumferential edge 255 of the burner body 280, and plural fuel exit holes 276 are defined in the burner body 280 adjacent to the ignitor hood 275 to promote collection and ignition of the gaseous fuel, and a fuel supply line 263 communicates between fuel port 279 carried under the fuel port hood 195, and the valve body 265 to supply the fuel to the burner 250, the fuel supply line 265 is positionally secured to the interior top surface 190 of the bottom panel 184 by a fuel line securing bracket 264; and wherein the length dimension 43 of the riser leg 41 of the cover/rear pot support hinge first portion 38, relative to the length dimension 103 of the first and second pivot arms 100, 130 maintains the pot support 140 in an orientation that is continuously parallel with the top surface 170 of the water tray 160.

In compliance with the Statute, the invention has been described in language more or less specific as to the structural and methodical features. It is to be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalence.

We claim:

1. A collapsible camp stove for controlled combustion of gaseous fuel comprising:

a chassis having a water tray, a bottom panel, a first end cap, a second end cap, a pot support; and a fuel burner; the water tray is heat reflective and generally rectilinear in peripheral configuration, and has a top exterior surface, an opposing bottom interior surface, a front portion, a rear portion, a first lateral side portion having a first side flange, a second lateral side portion having a second side flange, and a front panel that defines cutouts for an igniter button and a control knob, and pivot leg cutouts, wind baffle locking slots, and burner cut-outs are defined in the top exterior surface, and a cover/rear pot support hinge second portion is structurally carried on the top exterior surface adjacent to the rear portion for pivotal interconnection with a cover/rear pot support hinge first portion carried by a cover; and the pot support has a front portion, a rear portion, a first lateral side portion, a second lateral side portion, a bottom, and a top, and the pot support is pivotally movable relative to the water tray on a first pivot arm, and a second pivot arm that are pivotally interconnected to the first and second lateral sides, proximate the front, and on rear pot support hinge portions carried by the cover proximate the rear portion so that the pot support moves in, and is maintained in, a continuously parallel orientation, and in parallelogram configuration relative to the water tray responsive to the cover being pivotally opened and closed relative to the chassis; and the first end cap and the second end cap form first and second side portions of the chassis and each has a recess, defined in a laterally inner side portion, to facilitate flush mounting the side flanges, of the water tray to the end caps, and angled fillets, are defined in the laterally inner side portion spacedly adjacent a bottom to facilitate non-flush mounting with bottom panel to prevent heat conduction from the bottom panel to the end caps, and two spaced apart leg end saddles are defined by each end cap, adjacent the bottom, to pivotally carry legs; and the bottom panel has a front edge, a rear edge, a first side, a second side, an exterior bottom surface, an interior top surface, and defines a plurality of spacedly arrayed air vents, and an angled side flange is carried at the first side, and at the second side, and each side flange is configured to engage with the adjacent end cap, in a non-flush mounting orientation so that a gap is maintained between each side flange and the adjacent end cap, to minimize heat conduction therebetween, and a fixed distance is maintained between the top interior surface of the bottom panel, and the bottom interior surface of the water tray so that air-flow is maintained therebetween; and the burner is carried adjacent above the bottom panel, and adjacent below the water tray, and aligned with burner cutout, and the burner is annular in configuration and has a fuel tube that extends radially outwardly from an outer circumferential edge, and a valve body is carried at a second end portion of the fuel tube spaced apart from the outer circumferential edge, and has an operator control knob positioned on the front panel for user access, and a fuel supply line communicates between a fuel port proximate the rear edge, and the valve body to supply fuel to the burner; and a cover is pivotally interconnected to the chassis and has an exterior top surface and an interior bottom surface and structurally carries a cover/rear pot support hinge first portion on the interior bottom surface adjacent a rear bottom edge to pivotally interconnect with a cover/rear pot support hinge second portion carried by the chassis, and the cover/rear pot support hinge first portion has a riser leg with a pot support saddle that is configured to rotatably engage with the pot support to move the pot support in an arc relative to the water tray and at a predetermined fixed distance from the water tray; and a length dimension of the riser leg of the cover/rear pot support hinge first portion, relative to a length dimension of the first and second pivot arms, maintains the top and bottom of the pot support in an orientation that is continuously parallel with the top surface of the water tray; and pivotal opening and closing of the cover relative to the chassis moves the pot support between a first position parallel to and immediately adjacent the water tray and a second position parallel to and spaced apart above from the water tray.

2. The collapsible camp stove of claim 1 and further comprising:

a wind baffle pivotally interconnected to a wind baffle hinge first portion carried at the first lateral edge bottom edge and at the second lateral edge bottom edge of the cover, and each wind baffle has a generally "L" configuration with a laterally exterior facing surface, a laterally interior facing surface, a hinge edge, a bottom edge having a position locking tab at an end portion opposite the hinge edge, and the hinge edge structurally carries a wind baffle hinge second portion that is configured to axially slide along a hinge pin carried by the wind baffle hinge first portion so that each wind baffle is both rotatably movable about the hinge pin and also axially movable along the hinge pin between a first folded in/retracted position and a second extended use position, and the laterally interior facing surface of each wind baffle has at least one pleat thereon that frictionally contacts the interior bottom surface of the cover when the wind baffle is in the first folded/retracted position to prevent adhesion to the cover interior bottom surface.

3. The collapsible camp stove of claim 2 and further comprising:

a magnet carried by the cover at an edge portion to be magnetically attracted to a ferrous body carried by the chassis to magnetically positionally secure the cover in a closed orientation relative to the chassis.

4. The collapsible camp stove of claim 3 and further comprising:

a pot support lock is carried in a notch defined in the second end cap laterally outer side portion proximate the front end portion, and the pot support lock has a laterally exterior facing surface that defines a finger grip, an opposing interior facing surface that carries a locking boss that releasably engages within a locking recess defined in the second pivot arm second end portion, and the pot support lock is biased by a spring, relative to the second end cap into a position for secure releasable engagement with the locking recess defined in the second pivot arm, and an arcuate camming surface extending partially about the second end portion of the second pivot arm facilitates frictional sliding engagement of the second end portion over the locking boss which forces the locking boss downwardly and overcoming the spring biasing as the second pivot arm rotates about pivot axle, and a lock cap, that is secured with fasteners positionally secures the spring and the pot support lock in the notch defined in the second end cap and maintains the positional biasing of the pot support lock toward the top portion of the second end cap and into engagement with the locking recess.

5. The collapsible camp stove of claim 4 and further comprising:

a fuel port hood pivotally carried by the bottom panel on a hinge adjacent to the fuel input port to pivot the fuel port hood downwardly relative to the bottom panel; and to prevent access to the fuel input port without prior deployment of the pivoting legs relative to the chassis.

6. The collapsible camp stove of claim 1 and wherein a thickness dimension of the collapsible camp stove, when in a collapsed transport configuration, from the top exterior surface of the cover, to the bottom exterior surface of the bottom panel is less than 50 mm.

7. The collapsible camp stove of claim 1 and wherein a thickness dimension of the collapsible camp stove, when in a collapsed transport configuration, from the top exterior surface of the cover, to the bottom exterior surface of the bottom panel is less than 45 mm.

8. The collapsible camp stove of claim 1 and wherein a thickness dimension of the collapsible camp stove, when in a collapsed transport configuration, from the top exterior surface of the cover, to the bottom exterior surface of the bottom panel is less than 40 mm.

9. The collapsible camp stove of claim 1 and wherein a thickness dimension of the collapsible camp stove, when in a collapsed transport configuration, from the top exterior surface of the cover, to the bottom exterior surface of the bottom panel is approximately 35 mm.

10. The collapsible camp stove of claim 1 and wherein the cover/rear pot support hinge first portion is structurally carried on the interior bottom surface of the cover adjacent to the rear bottom edge to pivotally interconnect with a cover/rear pot support hinge second portion carried by the chassis, and each cover/rear pot support hinge first portion has a pin barrel to axially receive a hinge pin therein, and has a riser leg extending distally from the pin barrel, the riser leg structurally carrying a generally "U" shaped pot support saddle at an edge portion opposite the pin barrel, and the pot support saddle is configured to engage with, and securely rotatably carry, a rear-most rail of the pot support, and the pot support saddle moves in an arc relative to the pin barrel and at a predetermined fixed distance from the pin barrel.

11. The collapsible camp stove of claim 1 and wherein the pot support bottom is parallel to, and immediately adjacent to, the top surface of the water tray when the cover is in a closed orientation relative to the chassis, and the pot support bottom is spaced apart from the top surface of the water tray a distance of 41 mm, and parallel to the top surface, when the cover is in an open orientation relative to the chassis.

12. The collapsible camp stove of claim 1 and wherein the first pivot arm is formed of a heat resistant material, is elongate and has a first end portion, a non-circular second end portion, a laterally exterior facing surface, a laterally interior facing surface, an axle hole defined in the first end portion, an axle hole defined in the second end portion with a length dimension therebetween, and the second end portion is radially enlarged to define an arcuate camming surface, a flat support surface and a corner portion, and the first end portion of the first pivot arm is pivotally interconnected to the first lateral side portion of the pot support spacedly adjacent the front portion on a pivot axle that extends through the axle hole and the noncircular second end portion is pivotally interconnected to a laterally inner side portion of the first end cap on a pivot axle that extends through the axle hole defined in the second end portion adjacent above a pivot arm boss carried by the first end cap so that the flat support service and corner portion frictionally and/or compressively rests upon the pivot arm boss when the cover is in an open orientation relative to the chassis.

13. The collapsible camp stove of claim 1 and wherein the second pivot arm is formed of a heat resistant material, is elongate and has a first end portion, a non-circular second end portion, a laterally exterior facing surface, a laterally interior facing surface, an axle hole defined in the first end portion, and an axle hole defined in the second end portion with a length dimension therebetween, and the second end portion is radially enlarged and defines a lock recess and an arcuate camming surface, and the first end portion is pivotally interconnected with the second lateral side portion of the pot support spacedly adjacent the front portion on a pivot axle that extends through the axle hole and the second end portion is pivotally interconnected to laterally inner side portion of the second end cap on a pivot axle that extends through the axle hole in the second end portion, adjacent above a spring biased pot support lock carried by the second end cap.

14. The collapsible camp stove of claim 1 and wherein the first end cap forms a first side portion to the chassis and has a front end portion, a rear end portion, a laterally outer side portion, a laterally inner side portion, a top and a bottom with a thickness dimension between the top and the bottom, and a recess is defined in the laterally inner side portion spacedly adjacent to the top to facilitate flush mounting with the first side flange of the water tray, and angled fillets are defined in the laterally inner side portion spacedly adjacent the bottom to facilitate non-flush mounting with the bottom panel to prevent heat conduction from the bottom panel to the first end cap, and a cover engaging boss is defined on the laterally inner side portion adjacent to the front end portion to operatively cooperate with the second end portion of the first pivot arm, and two spaced apart leg end saddles/bosses are defined on the laterally inner side portion, adjacent to the bottom to pivotally carry a pivotally movable leg; and the second end cap forms a second side portion to the chassis and the second end cap carries a pot support lock, the second end cap has a front end portion, a rear end portion, a laterally outer side portion, a laterally inner side portion, a top and a bottom with a thickness dimension between the top and the bottom, and a recess is defined in the laterally inner side portion spacedly adjacent to the top to facilitate flush mounting with the second side flange of the water tray, and angled fillets are defined in the laterally inner side portion spacedly adjacent to the bottom to facilitate non-flush mounting with the bottom panel to prevent heat conduction from the bottom panel to the second end cap, a cover engaging boss is defined on the laterally inner side portion adjacent to the front end portion, and two spaced apart leg end saddles/bosses are defined by the second end cap on the laterally inner side portion, adjacent to the bottom portion to pivotally carry a pivotally movable leg.

15. The collapsible camp stove of claim 1 having plural burners, and each burner has a burner body that is comprised of a burner body top portion, a burner body bottom portion, a fuel atomizer ring, a fuel diffuser ring, and a Venturi vane that affects air pressure and promotes fuel/air mixing is carried within the fuel tube, the atomizer ring and diffuser ring are carried between the top portion and the bottom portion, and a plurality of spacedly arrayed flame ports are defined in the top portion for gaseous fuel to pass outwardly there-from for combustion, a radially extending exterior flange extends circumferentially about the burner body and mounting holes are defined in the exterior flange to carry fasteners for securing the burner body to the interior top surface of the bottom panel proximate the front edge, and proximate the rear edge with burner brackets, so that the burner body is secured to the chassis at two spaced apart locations to float relative to the chassis to accommodate thermal expansion, a Piezo ignitor, operatively communicates with the igniter button, and is carried in a ignitor hood adjacent the outer circumferential edge of the burner body, and plural fuel exit holes are defined in the burner body adjacent to the ignitor hood to promote collection of the gaseous fuel within the hood and ignition of the gaseous fuel.

16. The collapsible camp stove of claim 1 and wherein the water tray is metallic, heat reflective, generally rectilinear in peripheral configuration and has a generally planar top surface that defines a raised peripheral edge, an opposing bottom interior surface, a front portion, a rear portion, a first lateral side portion, a second lateral side portion, and a front panel that extends generally perpendicularly downwardly from the front portion, and the front panel defines plural spacedly arrayed cutouts for an igniter button and for a control knob, a first side flange at the first lateral side portion extends generally perpendicularly upwardly relative to the top surface, and a second side flange at the second lateral side portion extends generally perpendicularly upwardly relative to the top surface, and pivot leg cutouts, and wind baffle locking slots, are defined in the top surface spacedly adjacent to the first lateral side and spacedly adjacent to the second lateral side, and spaced apart from the front panel, and two spaced apart burner cutouts are defined in the top surface, each burner cutout has a peripheral edge that is angled upwardly opposite the bottom surface, and the cover/rear pot support hinge second portion is structurally carried on the top surface adjacent to the rear portion for pivotal interconnection with the cover/rear pot support hinge first portions carried by the cover.

17. A collapsible camp stove for controlled combustion of gaseous fuel comprising:

a chassis;

a cover pivotally interconnected to the chassis and;

a gaseous fuel burner carried by the chassis;

the cover is generally rectilinear in peripheral configuration and has plural spacedly arrayed integral polyhedral bends to add rigidity, the cover has an exterior top surface, an interior bottom surface, a front edge portion, a rear edge portion, a first lateral edge portion, and a second lateral edge portion, and each of the edge portions extend, in the same direction, generally perpendicularly away from the exterior top surface and toward the interior bottom surface, and each of the edge portions has an upper edge portion adjacent the exterior top surface, and each has a lower edge portion spaced apart from the exterior top surface;

a cover/rear pot support hinge first portion is structurally carried on the interior bottom surface of the cover adjacent to the rear bottom edge to pivotally interconnect with a cover/rear pot support hinge second portion carried by the chassis, each cover/rear pot support hinge first portion has a pin barrel to axially receive a hinge pin therein, and has a riser leg extending distally from the pin barrel, the riser leg structurally carrying a generally "U" shaped pot support saddle at an edge portion opposite the pin barrel, and the pot support saddle is configured to engage with, and securely rotatably carry, a rear-most rail of pot support, and the pot support saddle moves in an arc relative to the pin barrel and at a predetermined fixed distance from the pin barrel;

a wind baffle is pivotally interconnected to a wind baffle hinge first portion that is carried at the first lateral edge bottom edge and carried at the second lateral edge bottom edge of the cover, and each wind baffle has a generally "L" configuration with a laterally exterior facing surface, a laterally interior facing surface, a hinge edge, a bottom edge having a position locking tab at an end portion opposite the hinge edge, an upper edge that defines the "L" configuration, and the hinge edge structurally carries a wind baffle hinge second portion that is configured to axially slide along hinge pin carried by the wind baffle hinge first portion so that the wind baffle is both rotatably movable about the hinge pin and also axially movable along the hinge pin between a first folded in/retracted position and a second extended use position, and the laterally interior facing surface has at least one pleat thereon that frictionally contacts the interior bottom surface of the cover when the wind baffle is in the first folded/retracted position to prevent sticking to the cover interior bottom surface;

the chassis is comprised of a water tray, a bottom panel, a first end cap, a second end cap, a pot support; and the gaseous fuel burner;

the water tray is metallic, heat reflective, generally rectilinear in peripheral configuration and has a somewhat planar top surface that defines a raised peripheral edge, an opposing bottom interior surface, a front portion, a rear portion, a first lateral side portion, a second lateral side portion, and a front panel that extends generally perpendicularly downwardly from the front portion, and the front panel defines plural spacedly arrayed cutouts for an igniter button and a control knob, a first side flange at the first lateral side portion extends generally perpendicularly upwardly relative to the top surface, and a second side flange at the second lateral side portion extends generally perpendicularly upwardly relative to the top surface, and pivot leg cutouts, and wind baffle locking slots, are defined in the top surface spacedly adjacent to the first lateral side and to the second lateral side, and spaced apart from the front panel, and two spaced apart burner cutouts are defined in the top surface, each burner cutout has a peripheral edge that is angled upwardly opposite the bottom surface, and the cover/rear pot support hinge second portion is structurally carried on the top surface adjacent to the rear portion for pivotal interconnection with the cover/rear pot support hinge first portions carried by the cover;

the pot support is generally planar and rectilinear and is formed of a plurality of spacedly arrayed and structurally interconnected rails, that are preferably formed of metal, and the pot support has a front portion, a rear portion, a first lateral side portion, a second lateral side portion, a bottom, and the top for supporting cooking vessels thereon, the pot support has a rearmost rail at the rear portion that operatively, and removably, engages with the support saddle carried by the cover hinge/rear pot support first portion, and the pot support is pivotally interconnected to the chassis proximate the first end portion by a first pivot arm, and a second pivot arm so that the pot support moves in a continuously parallel orientation, and in parallelogram configuration relative to the chassis responsive to the cover being pivotally opened and closed relative to the chassis;

the first pivot arm is formed of a heat resistant material, is elongate and has a first end portion, a non-circular second end portion, a laterally exterior facing surface, a laterally interior facing surface, an axle hole defined in the first end portion, an axle hole defined in the second end portion with a length dimension therebetween, and the second end portion is radially enlarged to define a curved camming surface, a flat support surface and a corner portion, and the first end portion is pivotally interconnected with the first lateral side portion of the pot support spacedly adjacent the front portion on a pivot axle that extends through the axle hole at the first end portion, and the noncircular second end portion is pivotally interconnected to, laterally inner side portion of the first end cap on a pivot axle that extends through the axle hole defined in the second end portion adjacent above a pivot arm boss carried by the first end cap so that the flat support service and corner portion frictionally rest upon the pivot arm boss when the cover is in an open orientation;

the second pivot arm is formed of a heat resistant material, is elongate and has a first end portion, a non-circular second end portion, a laterally exterior facing surface, a laterally interior facing surface, an axle hole defined in the first end portion, and an axle hole defined in the second end portion with a length dimension therebetween, and the second end portion is radially enlarged and defines a lock recess and an arcuate camming surface, and the first end portion is pivotally interconnected with the second lateral side portion of the pot support spacedly adjacent the front portion on a pivot axle that extends through the axle hole in the first end portion, and the second end portion is pivotally interconnected to laterally inner side portion of the second end cap on a pivot axle that extends through the axle hole in the second end portion, adjacent above a spring biased pot support lock carried by the second end cap;

the first end cap is preferably of thermally resistant, and non-heat conductive material and forms a first side portion to the chassis and has a front end portion, a rear end portion, a laterally outer side portion, a laterally inner side portion, a top and a bottom with a thickness dimension between the top and the bottom, and a recess is defined in the laterally inner side portion spacedly adjacent to the top to facilitate flush mounting with the first side flange of the water tray, and angled fillets are defined in the laterally inner side portion spacedly adjacent the bottom to facilitate non-flush mounting with the bottom panel to prevent heat conduction from the bottom panel to the first end cap, a cover engaging boss is defined on the laterally inner side portion adjacent to the front end portion, and two spaced apart leg end saddles/bosses are defined by the first end cap on the laterally inner side portion, adjacent to the bottom to pivotally carry a pivotally movable leg;

the second end cap is also preferably of thermally resistant, and non-heat conductive material and forms a second side portion to the chassis and the second end cap carries the pot support lock, the second end cap has a front end portion, a rear end portion, a laterally outer side portion, a laterally inner side portion, a top and a bottom with a thickness dimension between the top and the bottom, and a recess is defined in the laterally inner side portion spacedly adjacent to the top to facilitate flush mounting with the second side flange of the water tray, and angled fillets are defined in the laterally inner side portion spacedly adjacent to the bottom to facilitate non-flush mounting with the bottom panel to prevent heat conduction from the bottom panel to the second end cap, a cover engaging boss is defined on the laterally inner side portion adjacent to the front end portion, and two spaced apart leg end saddles/bosses are defined by the second end cap on the laterally inner side portion, adjacent to the bottom portion to pivotally carry a pivotally movable leg; and the pot support lock is movably carried in notch defined in the second end cap laterally outer side portion proximate the front end portion, and the pot support lock has a laterally exterior facing surface that defines a finger grip, an opposing interior facing surface that carries a locking boss that releasably engages within the locking recess defined in the second end portion of the second pivot arm, and the pot support lock is biased by a spring into a position for secure releasable engagement with the locking recess defined in the second pivot arm, and the arcuate camming surface facilitates frictional sliding engagement of the second end portion over the locking boss which forces the locking boss downwardly and overcoming the spring biasing as the second pivot arm rotates, and a lock cap, that is secured with fasteners positionally secures the spring and the pot support lock in the notch and maintains the positional biasing of the pot support lock toward the top portion of the second end cap and into engagement with the locking recess; and the bottom panel is generally planar and rectilinear in peripheral configuration and has a front edge, a rear edge, a first side, a second side, an exterior bottom surface, an interior top surface, and defines a plurality of spacedly arrayed air vents that are each angled upwardly toward the interior top surface, a leg storage recess is defined in the bottom panel spacedly adjacent the first side and spacedly adjacent the second side for storage of the pivoting legs, a finger ignition recess is defined in the bottom panel adjacent the front edge and aligned with the igniter button of the front panel, a fuel input port is defined in the rear edge, and a fuel port hood is pivotally carried on a hinge adjacent to the fuel input port to pivot the fuel port hood downwardly relative to the bottom panel, an angled side flange is carried at the first side, and at the second side, and each side flange is configured to engage with the adjacent end cap, in a non-flush orientation so that a gap is maintained between each side flange and the adjacent end cap, to minimize heat conduction therebetween, and a fixed distance is maintained between the top interior surface of the bottom panel, and the bottom interior surface of the water tray so that a space for air-flow is maintained therebetween; and two pivoting legs, each having a generally U-shaped configuration, and each having two opposing spaced apart end portions and a medial portion that is offset from the opposing end portions, each end portion is releasably, pivotally carried within the leg end saddles, of the second end cap and the first end cap, and each pivoting leg is positionally maintained relative to the bottom panel by a leg lock having a position securing flange that frictionally engages with the pivoting leg proximate to the end portion to positionally maintain the pivoting leg in an over center position that is angularly outward of vertical relative to the bottom panel; and two burners are carried by the chassis adjacent above the bottom panel, and adjacent below the water tray, and the burners are each aligned with burner cutout defined in the water tray, and each burner has a burner ring that is annular in configuration and defines a medial hole with an inner circumferential edge, and has a fuel tube that extends radially outwardly from an outer circumferential edge of the burner ring, the fuel tube has a first end portion adjacent to the burner ring, and a second end portion spaced apart from the burner ring with a medial channel therebetween for passage of gaseous fuel therethrough, and a valve body is carried at the second end portion, the valve body has an operator a control knob that is positioned on the front panel for user access, each burner further has a burner body that is comprised of a burner body top portion, a burner body bottom portion, a fuel atomizer ring, a fuel diffuser ring, and a Venturi vane that alters air pressure and promotes fuel/air mixing is carried within the fuel tube, the atomizer ring and diffuser ring are positioned medially between the top portion and the bottom portion, and a plurality of spacedly arrayed flame ports are defined in the top portion for gaseous fuel to pass outwardly there-from for combustion, a radially extending exterior flange extends circumferentially about the burner body and mounting holes are defined in the exterior flange to carry fasteners for securing the burner body to the interior top surface of the bottom panel proximate the front edge, and proximate the rear edge with burner brackets, so that the burner body is secured to the chassis at only two spaced apart locations to float relative to the chassis to accommodate thermal expansion, a Piezo ignitor, operatively communicates with the igniter button on the front panel, and is carried in a ignitor hood adjacent the outer circumferential edge of the burner body, and plural fuel exit holes are defined in the burner body adjacent to the ignitor hood to promote collection and ignition of the gaseous fuel, and a fuel supply line communicates between fuel port carried under the fuel port hood, and the valve body to supply the fuel to the burner, the fuel supply line is positionally secured to the interior top surface of the bottom panel by a fuel line securing bracket; and wherein the length dimension of the riser leg of the cover/rear pot support hinge first portion, relative to the length dimension of the first and second pivot arms, maintains the pot support in an orientation that is continuously parallel with the top surface of the water tray.

18. The collapsible camp stove of claim 17 and wherein the pot support bottom is parallel to and immediately adjacent the top surface of the water tray when the cover is in a closed orientation relative to the chassis, and the pot support is spaced apart from the top surface a distance of 41 mm, and parallel to the top surface, when the cover is in an open orientation relative to the chassis.

19. The collapsible camp stove of claim 17 and wherein a thickness dimension of the collapsible camp stove, when in a collapsed transport configuration, from the top exterior surface of the cover, to the bottom exterior surface of the bottom panel is less than 40 mm.

20. The collapsible camp stove of claim 1 and wherein the rear portion of the pot support is removable from the pot support saddle to allow the pot support to pivot about the first and second pivot arms to facilitate cleaning of the bottom of the pot support and cleaning of the water tray.

* * * * *